US011698079B2

(12) United States Patent
Le et al.

(10) Patent No.: US 11,698,079 B2
(45) Date of Patent: Jul. 11, 2023

(54) FLUID SEALING MEMBER AND FLUID PUMP AND MOTOR HAVING FLUID SEALING MEMBER

(71) Applicant: Luraco, Inc., Arlington, TX (US)

(72) Inventors: Kevin Le, Richland Hills, TX (US); Thanh Le, Arlington, TX (US)

(73) Assignee: LURACO, INC., Arlinton, TX (US)

( * ) Notice: Subject to any disclaimer, the term of this patent is extended or adjusted under 35 U.S.C. 154(b) by 0 days.

(21) Appl. No.: 15/700,091

(22) Filed: Sep. 9, 2017

(65) Prior Publication Data

US 2019/0078576 A1 Mar. 14, 2019

(51) Int. Cl.

| | |
|---|---|
| ***F04D 29/10*** | (2006.01) |
| ***F04D 29/42*** | (2006.01) |
| ***F04D 25/02*** | (2006.01) |
| ***F04D 29/12*** | (2006.01) |

(52) U.S. Cl.

CPC ..... *F04D 29/106* (2013.01); *F04D 25/026* (2013.01); *F04D 29/4226* (2013.01); *F04D 29/4246* (2013.01); *F04D 29/126* (2013.01)

(58) Field of Classification Search

CPC .... F04D 29/106; F04D 29/126; F04D 13/024; F04D 25/026; F04D 29/40; F04D 29/60; F04D 29/108; F04D 29/12; H02K 5/124; H02K 5/173; F16J 15/16; F16J 15/18; F16J 15/26; F16J 15/44

USPC ..... 277/358; 417/423.11

See application file for complete search history.

(56) References Cited

U.S. PATENT DOCUMENTS

| | | | | |
|---|---|---|---|---|
| 2,506,886 A | | 5/1950 | Okulitch et al. | |
| 2,545,422 A | * | 3/1951 | Blom | F04D 13/083 277/366 |
| 2,598,484 A | * | 5/1952 | Adams | F16J 15/363 417/423.11 |

(Continued)

FOREIGN PATENT DOCUMENTS

| | | |
|---|---|---|
| GB | 805539 A | 12/1958 |
| GB | 2156218 A | 10/1985 |

OTHER PUBLICATIONS

SpaEquip User Manual (which contains the Sanijet Pipeless Hydrotherapy, Pipeless Whirlpool Foot Bath Owner's Manual for Model: FB2-S115), revised Sep. 2004.

(Continued)

*Primary Examiner* — Philip E Stimpert

(74) *Attorney, Agent, or Firm* — Norred Law, PLLC; Warren Norred; Alec Turung

(57) ABSTRACT

The present invention is directed to a fluid sealing member and a motor for preventing or reducing chances of fluids and/or substances or products from entering the motor chamber or cavity of a motor and causing damage to the motor's internal components and/or causing the motor to make undesirable noises or sounds. The present invention is also directed to a motor having a fluid sealing member, and to a fluid pump having a fluid sealing member. The present invention is further directed to a fluid pump that comprises a jet assembly and a motor assembly, which comprises a motor. The fluid pump may further comprise one, some or all of the following: a fluid sealing member, a mounting housing member or coupling device, a gasket or seal, a liner (when a liner is not already provided or present), and a driven magnetic disc assembly having a magnetic pole array.

34 Claims, 29 Drawing Sheets

(56) References Cited

U.S. PATENT DOCUMENTS 2,951,689 A 9/1960 Asp et al.
2,958,517 A 11/1960 Harker et al.
3,089,514 A * 5/1963 Sudmeier ..... F16L 55/00 137/563
3,198,125 A 8/1965 Yuza et al.
3,299,819 A 1/1967 McCoy
3,411,450 A 11/1968 Clifton
3,572,651 A 3/1971 Harker
3,630,645 A 12/1971 Eheim
3,932,068 A 1/1976 Zimmermann
3,941,517 A 3/1976 Miyahara
3,945,649 A * 3/1976 Nakamura ..... F16J 15/20 277/417
4,082,380 A 4/1978 Klaus et al.
4,115,040 A 9/1978 Knorr
4,135,863 A 1/1979 Davis et al.
4,226,574 A 10/1980 Villette
4,304,532 A 12/1981 McCoy
4,513,735 A 4/1985 Friedson et al.
4,523,580 A 6/1985 Tureaud
4,569,337 A 2/1986 Baumann et al.
4,606,698 A 8/1986 Clausen et al.
4,848,776 A * 7/1989 Winckler ..... F16J 15/3256 277/572
5,414,878 A 5/1995 Booth
5,458,459 A 10/1995 Hubbard et al.
5,587,023 A 12/1996 Booth
5,714,817 A * 2/1998 Norris ..... G11B 19/2009 310/90
5,980,112 A 11/1999 Matthews
6,997,688 B1 * 2/2006 Klein ..... F04D 29/126 417/420
7,108,202 B1 9/2006 Chang
7,111,334 B2 9/2006 Chen
7,168,107 B2 1/2007 Gruenwald
7,393,188 B2 7/2008 Lawyer et al.
7,574,756 B2 8/2009 Tran
8,214,937 B2 7/2012 Lawyer et al.
8,531,048 B2 9/2013 Tran et al.
8,662,848 B2 3/2014 Tran
8,944,786 B1 * 2/2015 McDougall ..... H01L 23/043 4/541.3
9,276,451 B2 * 3/2016 Oda ..... H02K 5/1672
9,450,475 B2 9/2016 Zumstein
9,551,343 B2 1/2017 Marks et al.
9,926,933 B2 3/2018 Le et al.
2005/0262627 A1 12/2005 Chen
2006/0210412 A1 * 9/2006 Lawyer ..... F04D 29/628 417/420
2006/0242760 A1 * 11/2006 Chao ..... A61H 35/006 4/622
2009/0064406 A1 * 3/2009 Lawyer ..... A61H 35/006 4/541.1
2010/0074777 A1 3/2010 Laufer et al.
2010/0239435 A1 9/2010 Le et al.
2011/0004994 A1 1/2011 Le et al.
2011/0079301 A1 * 4/2011 Karihara ..... F16K 15/181 137/511
2011/0116948 A1 5/2011 Yi et al.
2011/0211982 A1 9/2011 Marks et al.
2011/0223047 A1 9/2011 Tran et al.
2011/0253236 A1 10/2011 Le et al.
2011/0305562 A1 12/2011 Matsunaga et al.
2012/0045352 A1 * 2/2012 Lawyer ..... F04D 13/024 417/410.1
2012/0156071 A1 6/2012 Hijikata et al.
2014/0377100 A1 * 12/2014 Le ..... F04D 29/0465 417/420
2015/0090541 A1 * 4/2015 Koziol ..... B60T 17/228 188/153 R

OTHER PUBLICATIONS

Petra Collection Owner's Manual (which contains instructions for Sanijet-Pipeless System users), last updated Oct. 19, 2004, and copyright 2005.
ANS Gspa F Pedicure Spa (http://buynailsdirect.com/nails-salon-pedicure-spas/glass-sink-sgas/ans-gspa-f-pedicure-sga.html), Aug. 15, 2016.
Lexor Pedicure Spa User Manual (http://uspedicurespa.com/resources/lexor/luminous-spa-pedicure-chair-owner-manual.pdf), Aug. 15, 2016.
Maestro Pedicure Spa Owner's Manual (www.universalcompanies.com/FetchFile.ashx?id=c1571259-e567-4fcc-a079 . . . ), Aug. 15, 2016.
Hanning document titled "Drain Pumps Synchronous Drain Pumps DPS/DPO," downloaded Aug. 24, 2016.

* cited by examiner

FLUID SEALING MEMBER AND FLUID PUMP AND MOTOR HAVING FLUID SEALING MEMBER

BACKGROUND OF THE INVENTION

Field of the Invention

The present invention generally relates to devices, components, and systems in manicure and pedicure industries and in similar industries, such as, but not limited to, the swimming pool industry. More specifically, the present invention is directed to a fluid sealing member and a motor for preventing or reducing chances of fluids and/or substances or products from entering the motor chamber or cavity of a motor and causing damage to the motor's internal components and/or causing the motor to make undesirable noises or sounds. The present invention is also directed to a motor having a fluid sealing member, and a fluid pump having a fluid sealing member. The present invention is further directed to a fluid pump that comprises a jet assembly and a motor assembly, which comprises a motor. The fluid pump may further comprise one, some or all of the following: a fluid sealing member, a mounting housing member or coupling device, a gasket or seal, a liner (when a liner is not already provided or present), and a driven magnetic disc assembly having a magnetic pole array.

Description of the Related Art

Devices, components, and systems in manicure and pedicure industries and in similar industries are known in the art. Spa devices are used in commercial and recreational settings for hydrotherapy, massage, stimulation, pedicure, and bathing purposes. In the spa application setting, there are issues with fluids and/or substances or products entering the motor chamber or cavity and causing damage to the motor's internal components and/or causing the motor to make undesirable noises or sounds.

The present invention overcomes one or more of the shortcomings of devices, components, and systems in manicure and pedicure industries and in similar industries. The Applicant is unaware of inventions or patents, taken either singly or in combination, which are seen to describe the present invention as claimed.

SUMMARY OF THE INVENTION

The present invention is directed to a fluid sealing member and a motor for preventing or reducing chances of fluids and/or substances or products from entering the motor chamber or cavity of a motor and causing damage to the motor's internal components and/or causing the motor to make undesirable noises or sounds. The present invention is also directed to a motor having a fluid sealing member, and to a fluid pump having a fluid sealing member. The present invention is further directed to a fluid pump that comprises a jet assembly and a motor assembly, which comprises a motor, and dispenses fluid to a setting or work environment. The fluid pump may further comprise one, some or all of the following: a fluid sealing member, a mounting housing member or coupling device, a gasket or seal, a liner (when a liner is not already provided or present), and a driven magnetic disc assembly having a magnetic pole array.

The fluid sealing member is for use with motors used in manicure and pedicure industries and in similar industries, and used in, for example, a foot spa, a spa, a jacuzzi, a bathtub, or a swimming pool.

When the fluid sealing member is secured to a motor at the motor shaft hole, the fluid sealing member functions as a seal or plug at the motor shaft hole to prevent fluids and/or substances or products from entering the motor chamber or cavity via a distance gap between the motor shaft and the outer, non-sealed portion of the motor shaft hole when the motor shaft is positioned in the motor shaft hole.

As a non-limiting example, the motor has only one hole (a motor shaft hole). The motor is preferably a motor that is applicable to or used with the fluid sealing member so that they may be able to prevent or reduce chances of fluids and/or substances or products from entering the motor chamber or cavity of a motor and causing damage to the motor's internal components and/or causing the motor to make undesirable noises or sounds.

With regard to a fluid pump, the jet assembly is secured, attached or coupled to the motor assembly, which comprises a motor.

In a non-limiting embodiment, the jet assembly includes a jet assembly housing, and preferably also includes a printed circuit board (PCB), a PCB cover, a shaft assembly, and an impeller.

The jet assembly housing includes a base, a front or top cover, an impeller-receiving chamber defined by the base and front or top cover, at least one inlet aperture dimensioned and configured to allow a fluid to enter the jet assembly housing, and at least one outlet aperture dimensioned and configured to allow the fluid to exit or be dispensed from the jet assembly housing into a setting or a work environment.

The shaft assembly includes at least the shaft member.

The impeller, preferably a magnetic impeller, is configured to rotate about the shaft member and to rotate within the impeller-receiving chamber such that rotation of the impeller causes fluid to enter or flow into the inlet aperture and to exit or flow out of the outlet aperture.

The motor assembly may include and/or be coupled to the power source that enables rotation of the impeller.

Figure 1:
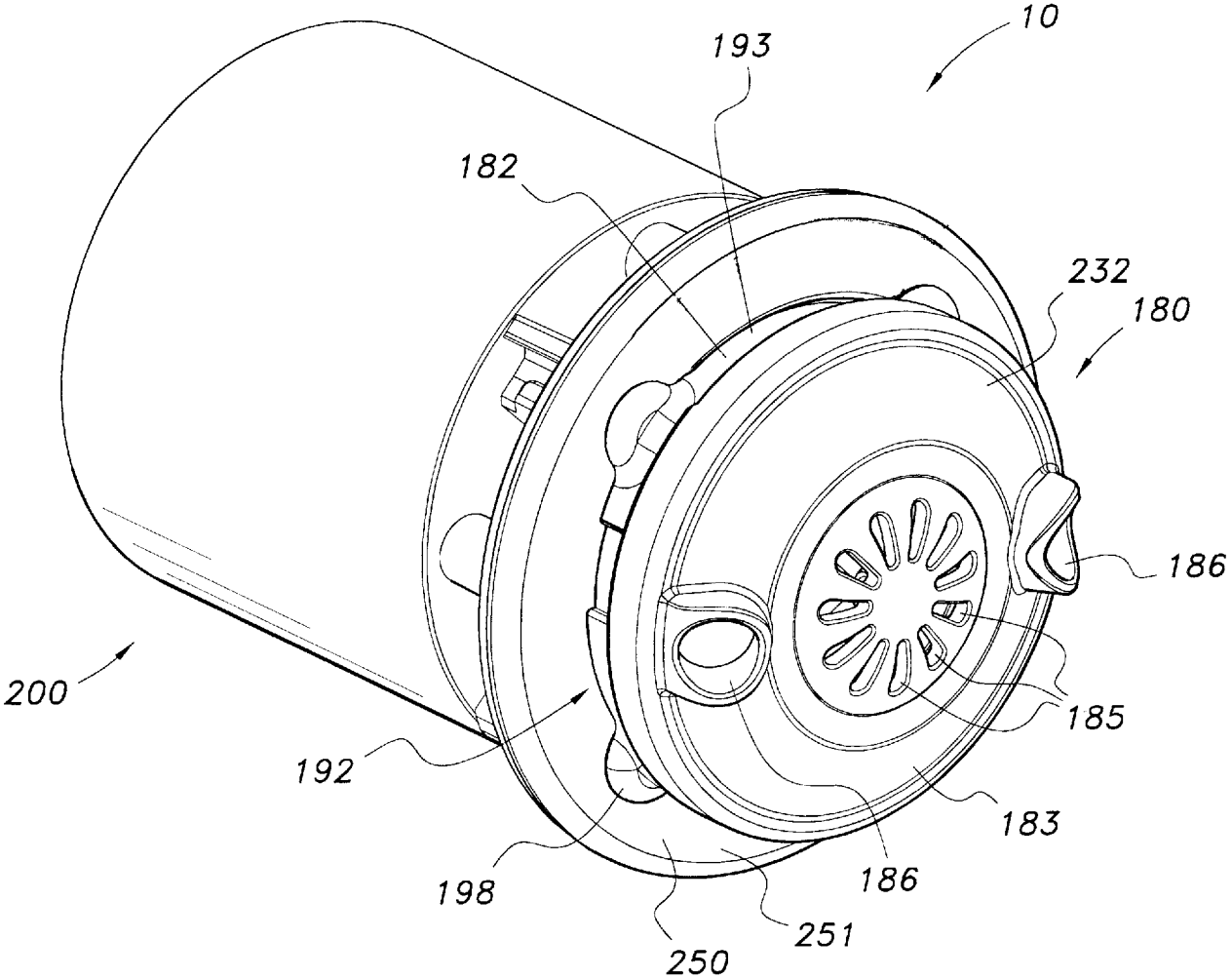
FIG. 1 is a front, right side, perspective view of a fluid pump according to the present invention, showing a jet assembly and a motor assembly secured or coupled to or about one another.

It should be understood that the above-attached figures are not intended to limit the scope of the present invention in any way.

DETAILED DESCRIPTION OF THE PREFERRED EMBODIMENTS

Referring to FIGS. 1-32, the present invention is directed to a fluid sealing member 600,700 and a motor 502,503 for preventing or reducing chances of fluids and/or substances or products from entering the motor chamber or cavity 520,521 of the motor 502,503 and causing damage to the motor's internal components and/or causing the motor 502, 503 to make undesirable noises or sounds. The present invention is also directed to a motor 502,503 having a fluid sealing member 600,700, and to a fluid pump 800, preferably a magnetic coupling-type fluid pump, having a fluid sealing member 600,700. The present invention is further directed to a fluid pump 10,300,800 that comprises a jet assembly 180 and a motor assembly 200, and dispenses fluid to a work environment or a setting SET, such as, but not limited, to a foot spa, a spa, a jacuzzi, a bathtub, or a swimming pool. The fluid pump 10,300,800 may further comprise one, some or all of the following: a fluid sealing member 600,700, a mounting housing member or coupling device 250, a gasket or seal 265, a liner 290 (when a liner is not already provided or present), and a driven magnetic disc assembly 209,900 having a magnetic pole array 210, 910.

As shown in FIGS. 19-23 and 25-26, the fluid sealing member 600,700 is for use with motors, such as, but not limited to, motor 502,503, used in manicure and pedicure industries and similar industries and used in, for example, a foot spa, a spa, a jacuzzi, a bathtub, or a swimming pool.

When the fluid sealing member 600 is secured to motor 502 at the motor shaft hole 512, the fluid sealing member 600 functions as a fluid-tight seal or plug at the motor shaft hole 512 of the motor cap 508, or motor shaft end 504 of the motor when the motor does not include a motor cap 508, to prevent fluids and/or substances or products from entering the motor chamber or cavity 520 through the motor shaft hole 512.

Figure 19:
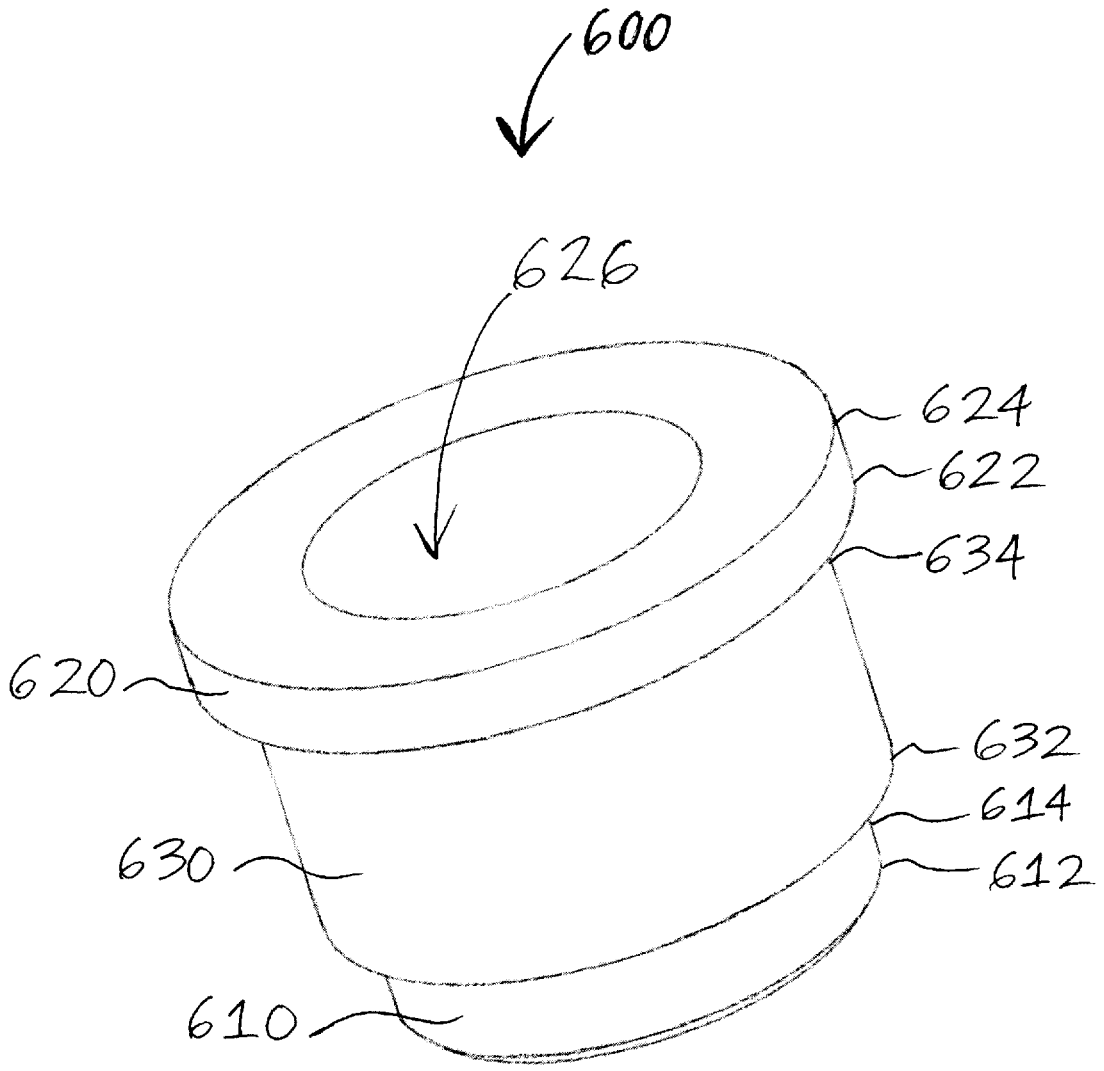
FIG. 19 is a perspective, first or upper end view of a fluid sealing member according to the present invention.
Figure 20:
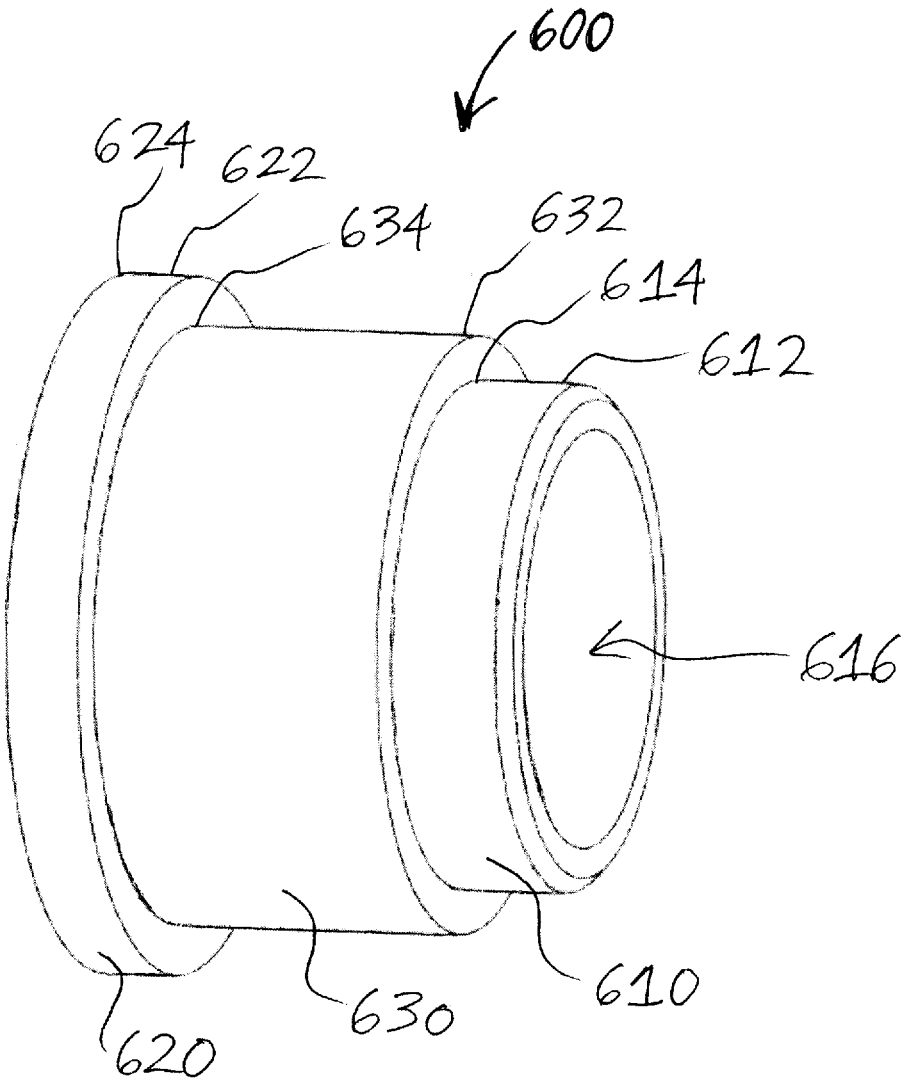
FIG. 20 is a perspective, side and second or lower end view of the fluid sealing member of FIG. 19.
Figure 21:
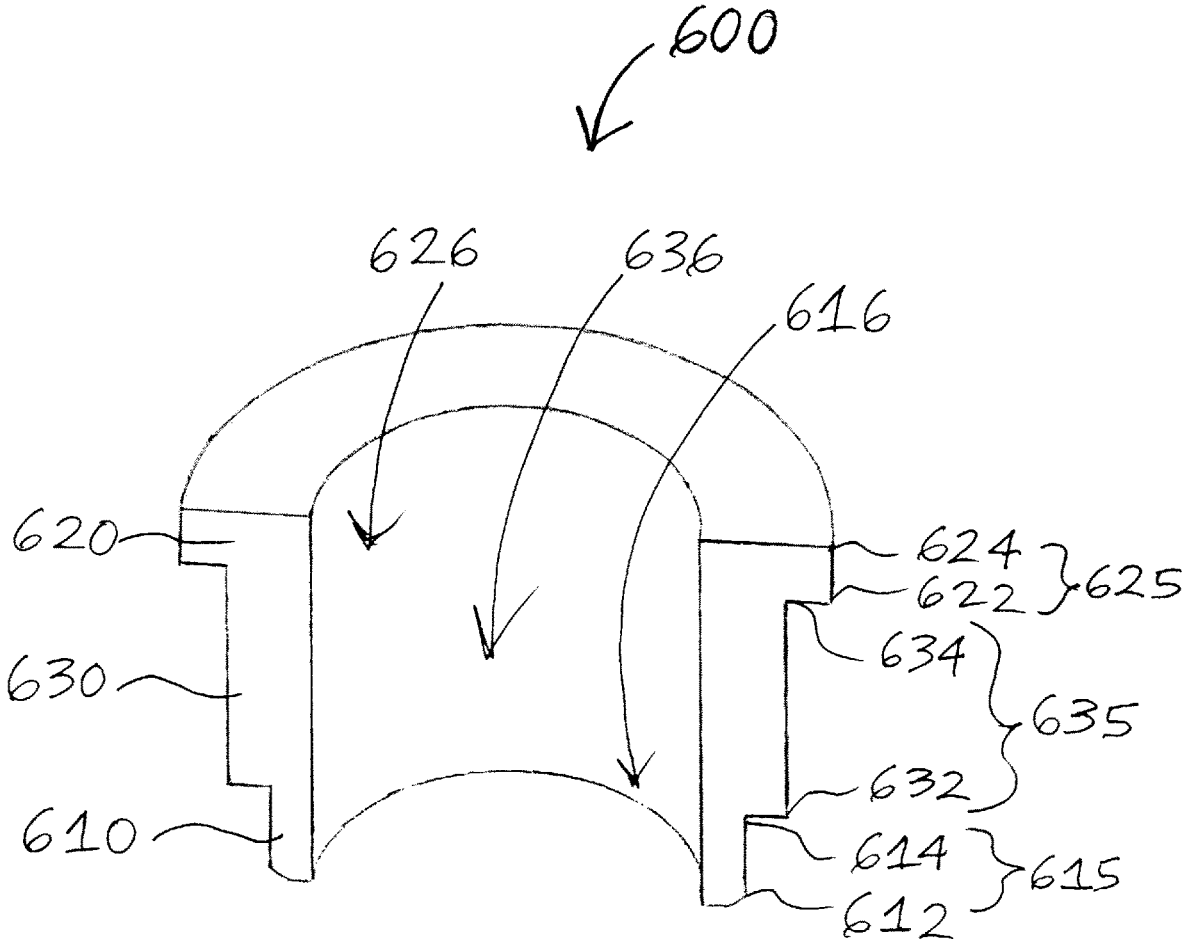
FIG. 21 is a cross-sectional view of the fluid sealing member of FIG. 19, from the upper end to the lower end.
Figure 22:
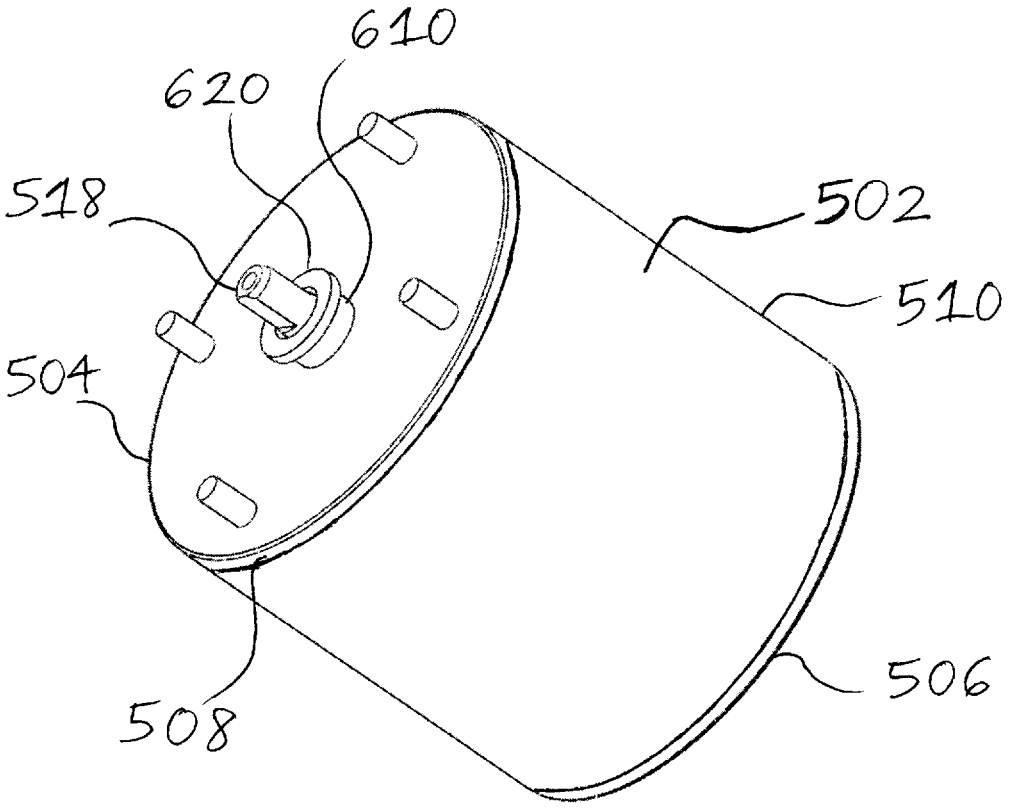
FIG. 22 is a perspective, first or shaft end view of a motor according to the present invention, showing the fluid sealing member of FIG. 19 positioned in a motor shaft hole of the motor.

As a non-limiting example and as best shown in FIGS. 19-21, the fluid sealing member 600 is preferably hollow and includes a lower end 610, an upper end 620 (preferably having a ring-like configuration), a cylindrical body 630 extending between the lower end 610 and upper end 620, and a cavity 640 extending from the lower end 610 to and through the upper end 620 and along inner portions of the lower end 610, upper end 620, and cylindrical body 630. Preferably, the fluid sealing member 600 is dimensioned and configured such that the diameter of the cylindrical body 630 is greater than the diameter of the lower end 610. More preferably, the fluid sealing member 600 is dimensioned and configured such that the diameter of the upper end 620 is greater than both of the diameters of the cylindrical body 630 and lower end 610, and the diameter of the cylindrical body 630 is greater than the diameter of the lower end 610.

The lower end 610 includes a first point 612, a second point 614, a body extension 615 extending from the first point 612 to the second point 614, and a cavity 616 extending from the first point 612 to and through the second point 614. Preferably, the junction area between the second point 614 of the lower end 610 and the first point 632 of the cylindrical body 630 of the fluid sealing member 600 forms or creates a water-tight or fluid-tight seal with the motor shaft hole 512 of the motor cap 508 or motor shaft end 504 of the motor 502 when the fluid sealing member 600 is inserted into or positioned in the motor shaft hole 512 such that fluids and/or substances or products used in the work environment will not be able to enter the motor chamber or cavity 520.

The upper end 620 includes a first point 622, a second point 624, a body extension 625 extending from the first point 622 to the second point 624, and a cavity 626 extending from the first point 622 to and through the second point 624, and is preferably configured to function as a flange where a mounting housing member 250 which secures or mounts a jet assembly housing 181 to the motor 502, makes contact with or is located in proximity of the second point 624 of the upper end 620 of the fluid sealing member 600.

The cylindrical body 630 includes the first point 632, a second point 634, a body extension 635 extending from the first point 632 to the second point 634, and a cavity 636 extending from the first point 632 to and through the second point 634. Preferably, the cylindrical body 630 has a predetermined length or height and is positioned external of the motor shaft hole 512 when the fluid sealing member 600 is inserted into or positioned in the motor shaft hole 512.

Figure 23:
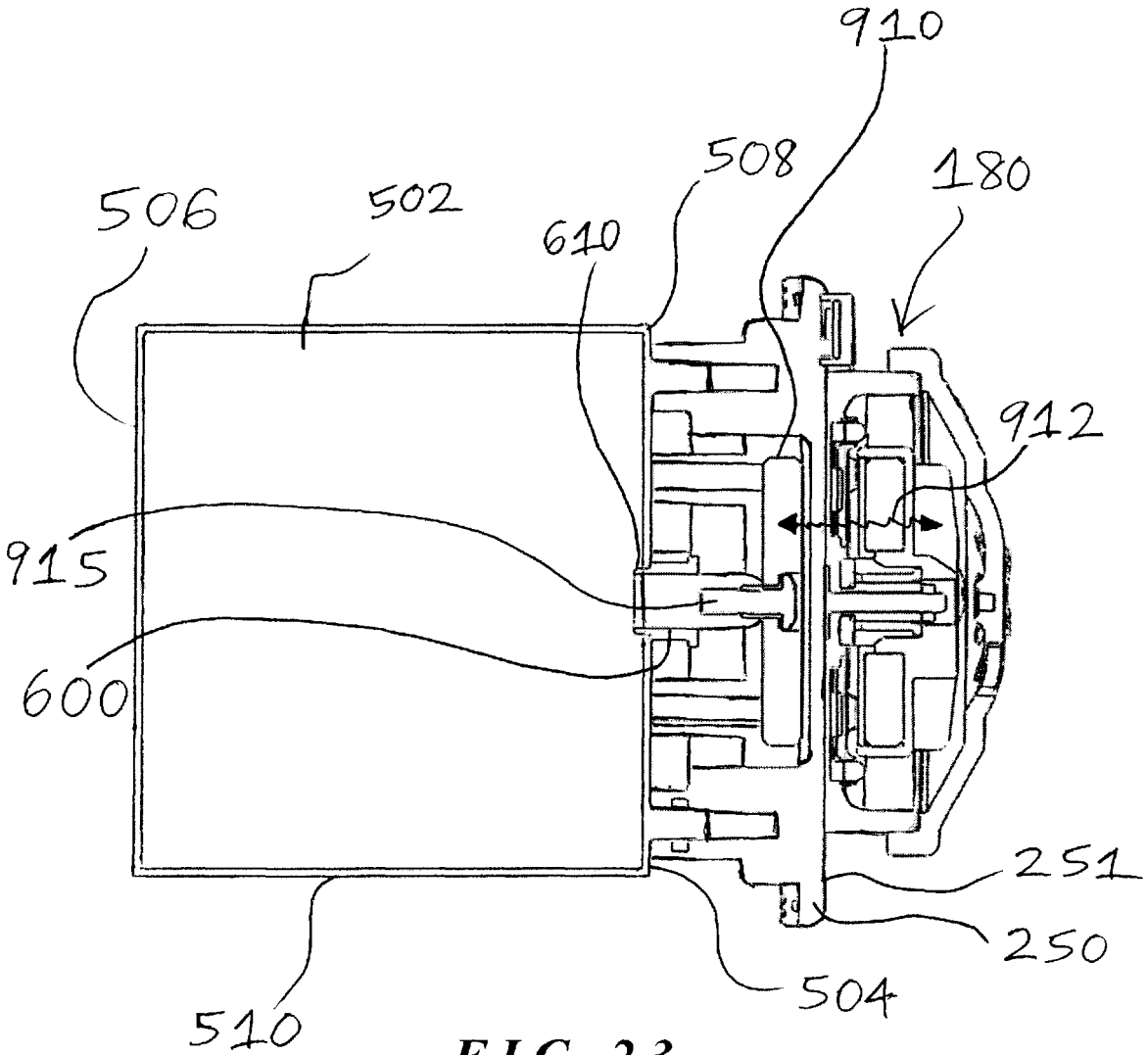
FIG. 23 is a partial cross-sectional view of a magnetic coupling-type fluid pump according to the present invention, showing a jet assembly, a mounting housing member, and the motor (with the fluid sealing member) of FIG. 22 being secured to one another.
Figure 24:
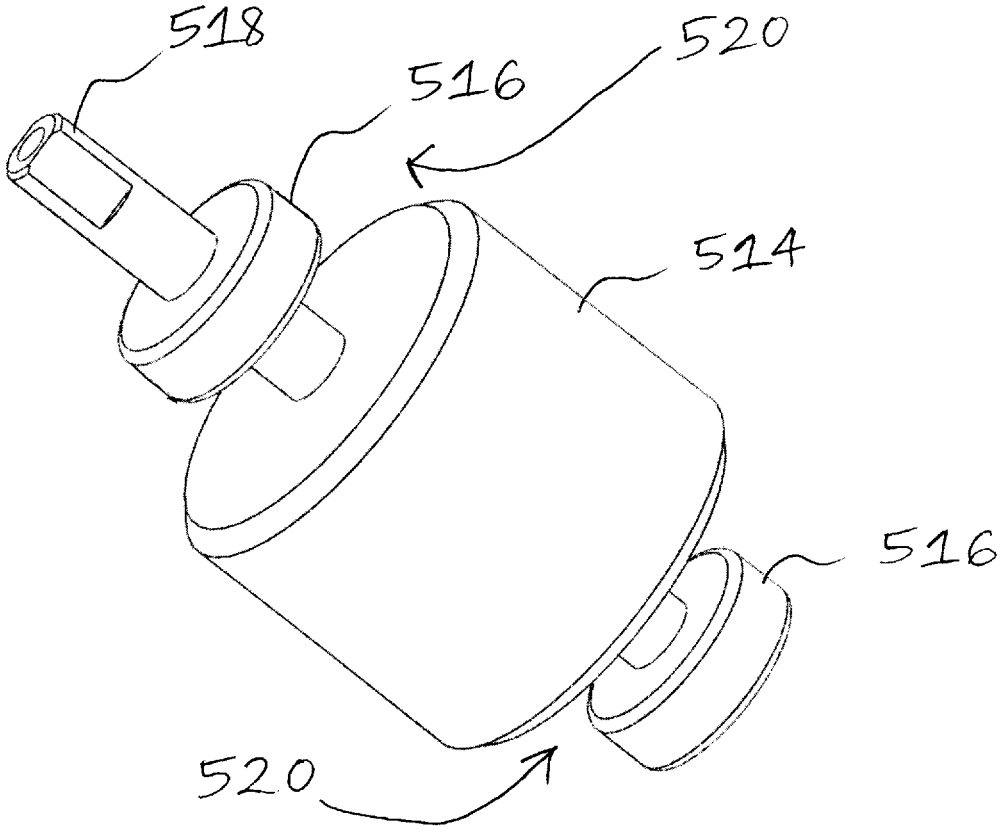
FIG. 24 is a perspective view of internal components of the motor of FIG. 22, showing a rotor, bearings, and a motor shaft.

As best shown in FIG. 23, the cavities 616,626,636 are dimensioned and configured for receiving the motor shaft 518.

The fluid sealing member 600 is preferably made or manufactured of a plastic material or engineered plastics, such as, but not limited to, a hard plastic material, any material(s) known to one of ordinary skill in the art, and any combination thereof.

Figure 25:
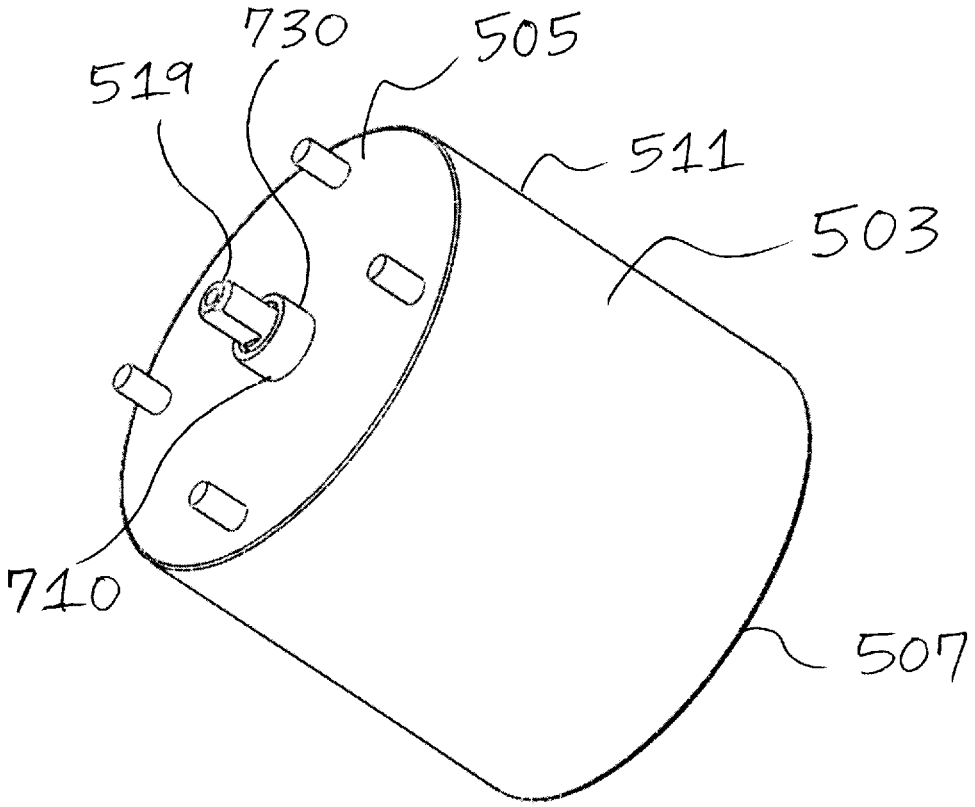
FIG. 25 is a perspective, first or shaft end view of a motor according to the present invention, showing another fluid sealing member being constructed with the shaft end of the motor in a one-piece unit.
Figure 26:
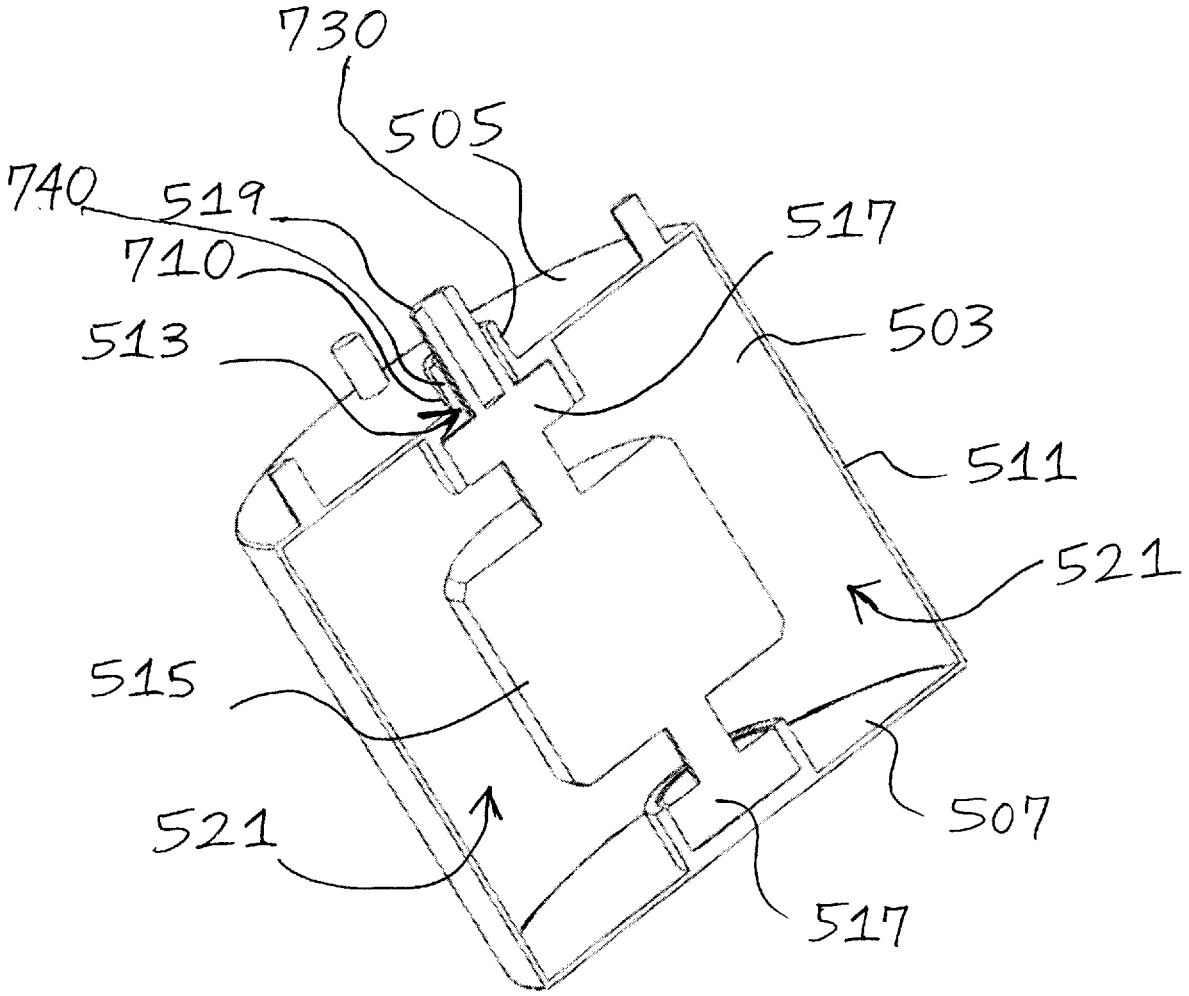
FIG. 26 is a cross-sectional view of the motor of FIG. 25, showing a rotor and bearings positioned within the substantially-enclosed structure of the motor.

In another non-limiting example and as shown in FIGS. 25 and 26, the fluid sealing member 700 may be built into the motor cap, or motor shaft end 505 of the motor 503 when the motor 503 does not include a motor cap, such that they are a one-piece unit where the the fluid sealing member 700 extends generally upward or vertically and outward away from the motor shaft hole 513 and motor chamber 521. This construction prevents or reduces the chance of fluids and/or substances or products from entering the motor chamber or cavity 521.

In this non-limiting example, the fluid sealing member 700 is preferably hollow and includes a lower end 710, a cylindrical body 730 extending upward or vertically from the lower end 710, and a cavity 740 extending from the lower end 710 and along inner portions of the lower end 710 and cylindrical body 730. Preferably, the fluid sealing member 700 is dimensioned and configured such that the diameter of the cylindrical body 730 is about equal to or greater than the diameter of the lower end 710. More preferably, the diameter of the cylindrical body 730 is substantially equal to or exactly the same as the diameter of the lower end 710

The lower end 710 of the fluid sealing member 700 forms or creates a water-tight or fluid-tight seal with the motor shaft hole 513 of the motor shaft end 505 of the motor 503 such that fluids and/or substances or products used in the work environment will not be able to enter the motor chamber or cavity 521.

The cylindrical body 730 has a predetermined length or height and is positioned external of the motor shaft hole 513.

As best shown in FIG. 26, the cavity 740 is dimensioned and configured for receiving the motor shaft 519.

The fluid sealing member 700 is preferably made or manufactured of metal, a plastic material or engineered plastics, such as, but not limited to, a hard plastic material, any material(s) known to one of ordinary skill in the art, and any combination thereof. Preferably, the fluid sealing member 700 is made or manufactured of the same material(s) that the motor 503 is made or manufactured of.

As a non-limiting example of a motor for the motor assembly 200 and as best shown in FIGS. 22-26, the motor may be motor 502,503 that is applicable to or used with the fluid sealing member 600,700, and includes a first or motor shaft end 504,505, a second end 506,507, a motor cap 508 at the motor shaft end 504, a sidewall 510,511 extending between the motor shaft end 504,505 and the second end 506,507, a motor shaft hole 512,513 at the motor shaft end 504,505, a rotor 514,515, bearings 516,517, a motor shaft 518,519, and a motor chamber or cavity 520,521. The motor shaft end 504,505, second end 506,507, and sidewall 510, 511 form a substantially-enclosed structure that define the motor chamber 520,521, which is where the rotor 514,515 and bearings 516,517 are positioned or reside. Preferably, the motor 502,503 has only one hole, i.e., the motor shaft hole 512,513, which is dimensioned and configured for receiving the motor shaft 518,519. Preferably, the motor shaft hole 512 and motor shaft 518 form a sufficient fit or seal with one another (when the implementation of the fluid sealing member 600 is not needed nor desired), or with one another and the fluid sealing member 600 (when the implementation of the fluid sealing member 600 is needed or desired), such that the sufficient fit or seal prevents fluids and/or substances or products from the work environment from entering the motor chamber 520.

Since fluids and/or substances or products, such as, but not limited to, water, salt, chemicals, sand, and massage lotions, from the work environment may possibly only gain access or entry to the motor chamber 520,521 via the motor shaft hole 512,513, the motor 502,503 will reduce or eliminate the chance (especially when the fluid sealing member 600,700 is present) that the internal components, such as the rotor 514,515 and bearings 516,517, of the motor 502,503 will be damaged from the fluids and/or substances or products entering the motor chamber 520,521. Besides damaging internal components, the presence of fluids and/or substances or products in the motor chamber 520,521 also may cause the motor 502,503 to make undesirable noises or sounds.

With regard to a fluid pump 10,300,800, the jet assembly 180 is secured, attached or coupled to the motor assembly 200, and this may be accomplished by various means. As a non-limiting example and as shown in FIGS. 1-4, the jet assembly 180 is secured, attached or coupled to or about the motor assembly 200 by the assistance of the mounting housing member 250.

As a non-limiting example and as best shown in FIGS. 4 and 6-15, the jet assembly 180 preferably includes: a jet assembly housing 181 that has a printed circuit board (PCB) 270 and a PCB cover 280; a shaft assembly 140; and an impeller 170. As an alternative, the jet assembly 180 may include: a jet assembly housing 181 that does not have the PCB 270 nor the PCB cover 280; a bearing and shaft assembly 100; and an impeller 170.

As shown in FIGS. 1, 3-5, 6, 9 and 13-15, the jet assembly housing 181 includes a base 182, a front or top cover 183, an impeller-receiving chamber 184 defined by the base 182 and front or top cover 183, a plurality of inlet apertures 185 dimensioned and configured to allow a fluid to enter the jet assembly housing 181 and preferably disposed about the central area of the front or top cover 183, and a plurality of outlet apertures 186 dimensioned and configured to allow the fluid to exit or be dispensed from the jet assembly housing into the setting SET and preferably disposed about the periphery of the front or top cover 183.

Figure 3:
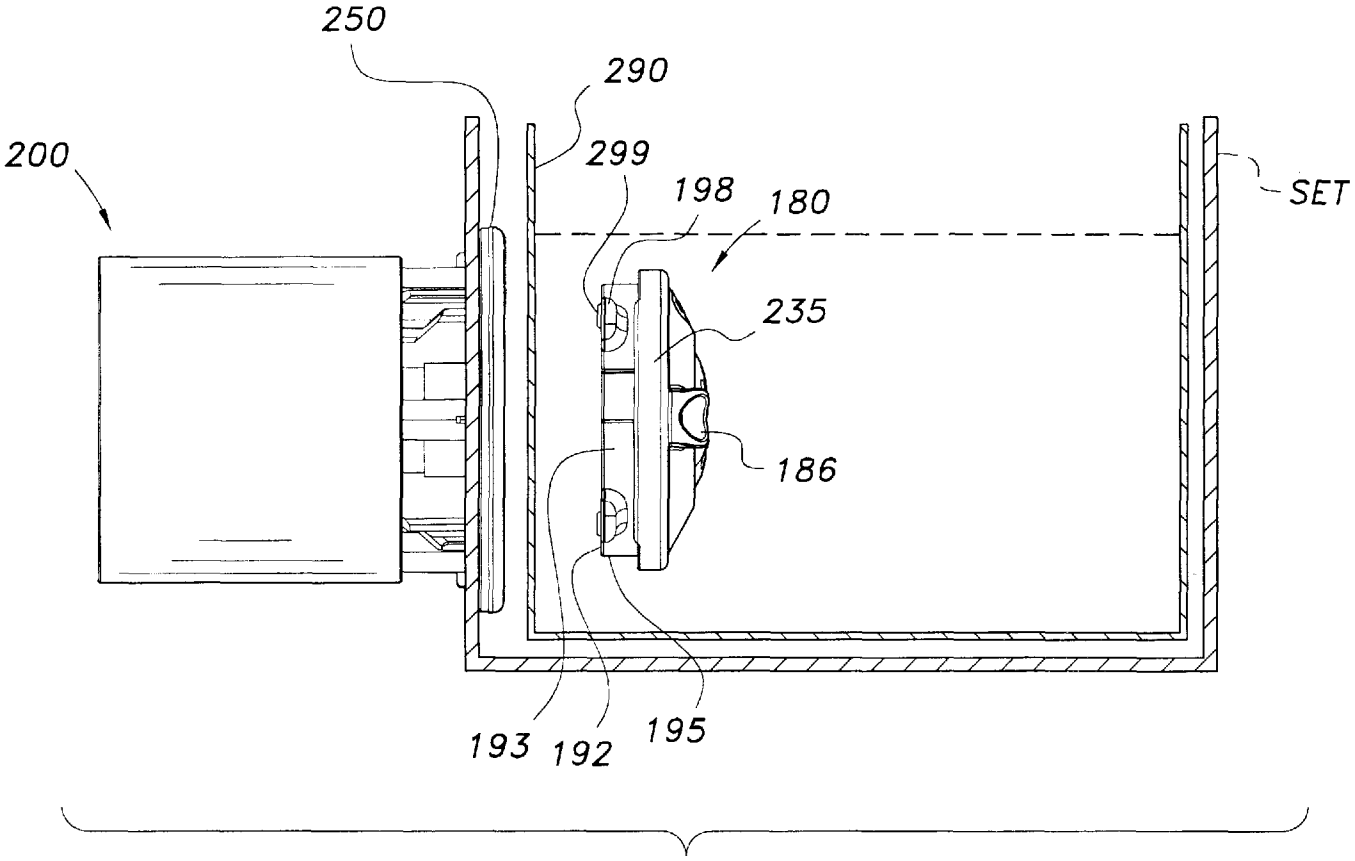
FIG. 3 is a right side, partial cross-sectional, environmental view of the fluid pump of FIG. 1, wherein the motor assembly is secured to or proximate to a setting, such as an internal wall of a foot spa, while the jet assembly will be secured or coupled to or about the motor assembly prior to operation or use, and wherein a liner will be positioned between the motor assembly and jet assembly prior to operation or use.

As best shown in FIGS. 4, 9 and 13-15, the base 182 of the jet assembly housing 181 has an inner surface 191, an outer surface 192, a circular wall 193 at or about the periphery of the base 182, a plurality of feet extensions 198, and a plurality of engagement recesses or grooves 199. Preferably, the outer surface 192 is generally flat or has a generally flat, centrally-located section 557 that allows for a liner 290 to be positioned behind (or below) the base 182 of the jet assembly housing 181 and in front of (or above) the contact surface of the setting SET and motor assembly 200, as shown in FIG. 3. The circular wall 193 has an inner surface 194, an outer surface 195, a front or top 196, and a rear or bottom 197. Each of the plurality of feet extensions 198 extends outwardly from about the rear or bottom 197 of the circular wall 193, and has a knob 299 extending rearwardly or downwardly from the corresponding feet extension 198 for engaging with the mounting housing member 250. Each of the plurality of engagement recesses or grooves 199 is positioned at a predetermined location about the outer surface 195 of the circular wall 193 for engaging with and securing the front or top cover 183. The base 182 may be made or manufactured of plastic, hard plastic, and/or any other suitable material known to one of ordinary skill in the art.

As best shown in FIGS. 1, 4, 6, 13 and 15, the front or top cover 183 of the jet assembly housing 181 has an inner surface 231, an outer surface 232, a circular wall 233 at or about the periphery of the front or top cover 183, a plurality of engagement protrusions 238, and a lock-receiving cavity 239. The circular wall 233 has an inner surface 234, an outer surface 235, a front or top 236, and a rear or bottom 237. Each of the plurality of engagement protrusions 238 is positioned at a predetermined location about the inner surface 234 of the circular wall 233 for engaging with a corresponding engagement recess or groove 199 of the base 182 such that the base 182 and front or top cover 183 may be detachably secured to one another prior to and during operation or use and also may be detachably unsecured from one another after operation or use for allowing access to the components, maintenance, etc. The lock-receiving cavity 239 is configured and positioned at a predetermined location about the inner surface 231 of the front or top cover 183 such that the lock-receiving cavity 239 receives the tip of the shaft member 150 (or locking mechanism 159') when the base 182 and front or top cover 183 are detachably secured to one another prior to and during operation or use. The front or top cover 183 may be made or manufactured of plastic, hard plastic, and/or any other suitable material known to one of ordinary skill in the art.

Preferably, the plurality of inlet apertures 185 form a diameter that is about equal to or smaller than the diameter of the impeller 170 so that there's a decreased chance of mixing between the inflow fluid and outflow fluid.

Preferably, each of the outlet apertures 186 has a nozzle. Preferably, each of the nozzles and an axis of the pump 10,300,800 form an angle less than 90 degree.

Figure 4:
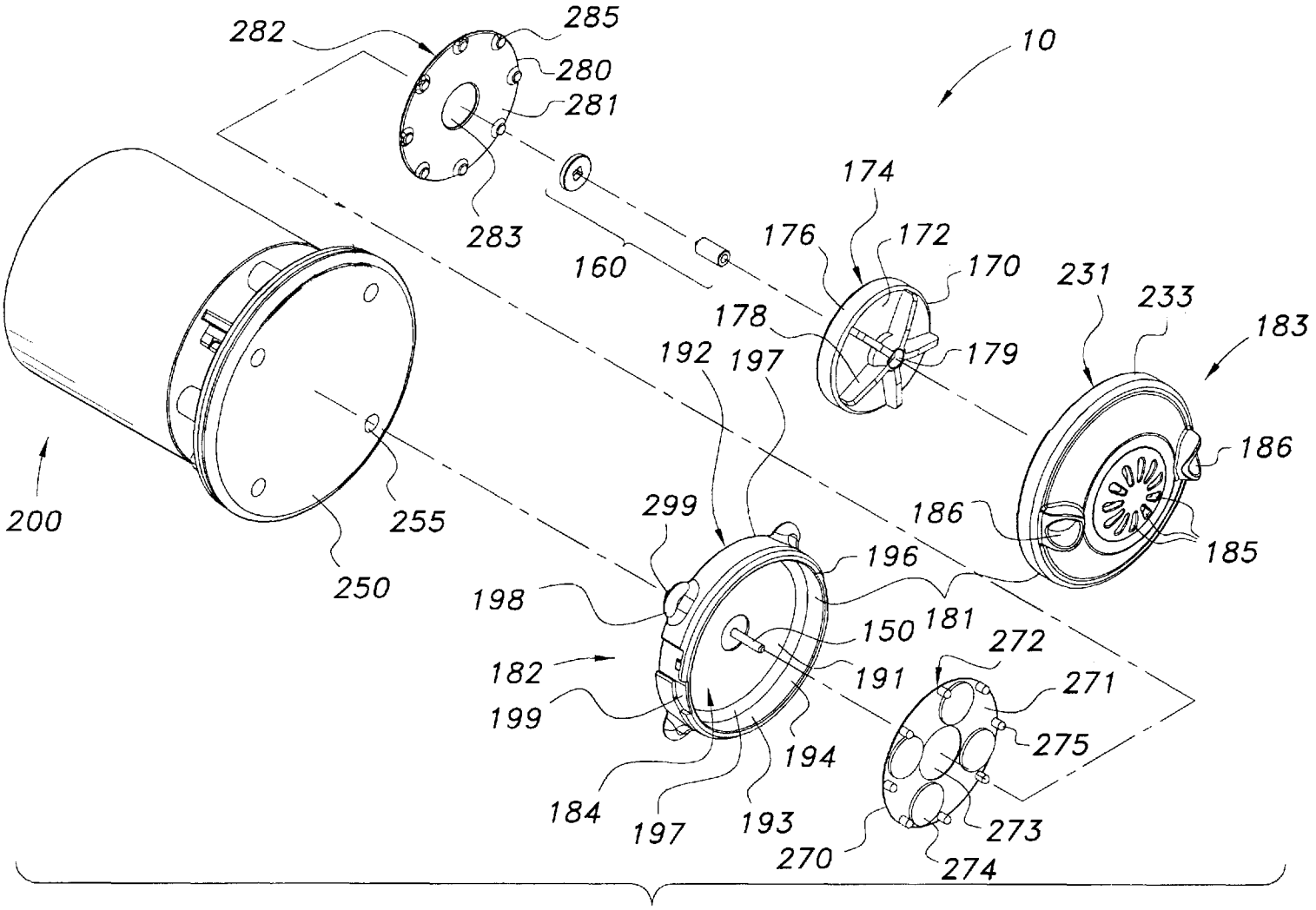
FIG. 4 is an exploded, perspective view of the fluid pump of FIG. 1.

As shown in FIG. 4, the PCB 270 of the jet assembly housing 181 has a "disc-like" configuration or shape, and includes a front or top side 271, a rear or bottom side 272, a hole 273, a plurality of inductive coils 274, and a light source 275, such as, but not limited to, a plurality of LED light members 275. The hole 273 allows the shaft member 150 to pass through, and is preferably centrally located. The plurality of inductive coils 274 are positioned at predetermined locations on the front or top side 271 proximate the hole 273. The plurality of LED light members 275 are positioned at predetermined locations on the front or top side 271 about the periphery of the PCB 270, and provide lighting or illumination to the jet assembly housing 181. The PCB 270 is secured or attached to the base 182 prior to operation or use such that the rear or bottom side 272 of the PCB 270 is adjacent or in close proximity to the inner surface 191 of the base 182. The PCB 270 may be secured or attached to the base 182 by any method known to one of ordinary skill in the art.

Preferably, the light source 275 is configured to emit a light that illuminates the first fluid when the magnetic pole array 177 of the impeller 170 is driven by the magnetic pole array 210,910 of the driven magnetic disc assembly 209, 900. The impeller 170 causes the first fluid to flow into the the plurality of inlet apertures 185 and out the the plurality of outlet apertures 186. Illuminating the first fluid via the light source 275 includes providing energy to the light source 275 via magnetic waves captured by the inductive coils 274, which are positioned between the impeller 170 and base 182 of the jet assembly housing 181. As a non-limiting example, the parameter of the illumination includes at least one of intensity, color, illumination sequencing, and any combination thereof.

As shown in FIG. 4, the PCB cover 280 of the jet assembly housing 181 has a "disc-like" configuration or shape, and includes a front or top side 281, a rear or bottom side 282, a hole 283, and a plurality of LED light member covers 285. The hole 283 allows the shaft member 150 to pass through, and is preferably centrally located. The plurality of LED light member covers 285 are positioned at predetermined locations on the front or top side 281 about the periphery of the PCB cover 280, and are adapted for being secured or attached with corresponding LED light members 275 of the PCB 270. The PCB cover 280 is positioned upon the PCB 270 such that the rear or bottom side 282 of the PCB cover 280 is adjacent or in close proximity to the front or top side 271 of the PCB 270.

As shown in FIGS. 4, 7-9, 13, 14 and 16, the shaft assembly 140 includes the shaft member 150, the shaft protection member 160, and, preferably, the locking mechanism 159.

The shaft member 150 includes a base 152 and a cylindrical body 154 extending upwardly from the base 152. The cylindrical body 154 has a first end 156 and a second end 158. As best shown in FIG. 4, the shaft member 150 and shaft protection member 160 are secured, attached, fixed or mounted within the housing 181, preferably in a central location upon the inner surface 191 of the base 182 of the housing 181, of the jet assembly 180 via the base 152 of the shaft member 150 being secured, attached, fixed or mounted to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

Figure 7:
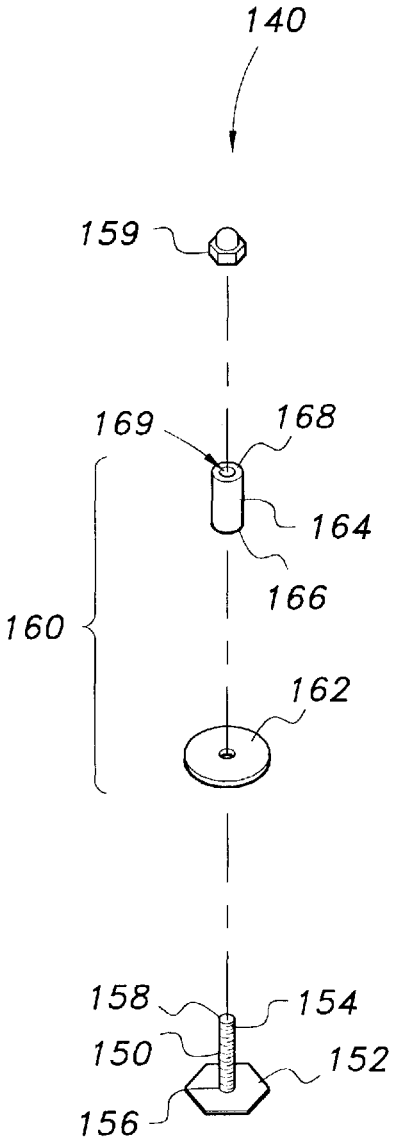
FIG. 7 is an exploded, perspective view of a shaft assembly according to the present invention.
Figure 8:
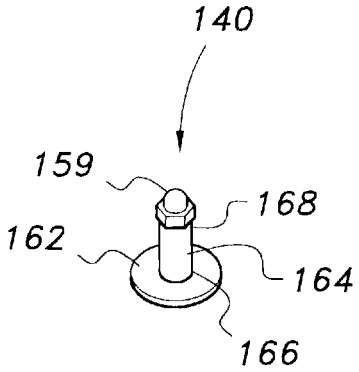
FIG. 8 is an assembly, perspective view of the shaft assembly of FIG. 7.

The shaft protection member 160 includes a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 7, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface. Further, the shaft protection member 160 is preferably made or manufactured as two pieces. It is obvious to one of ordinary skill in the art that the shaft protection member 160 may be made or manufactured as a single piece.

The locking mechanism 159 secures the impeller 170, preferably the magnetic impeller 170, within the housing 181 of the jet assembly 180. The locking mechanism 159 may be a locking nut that, when in use, is secured onto the second end 158 of the cylindrical body 154 of the shaft member 150.

Figure 13:
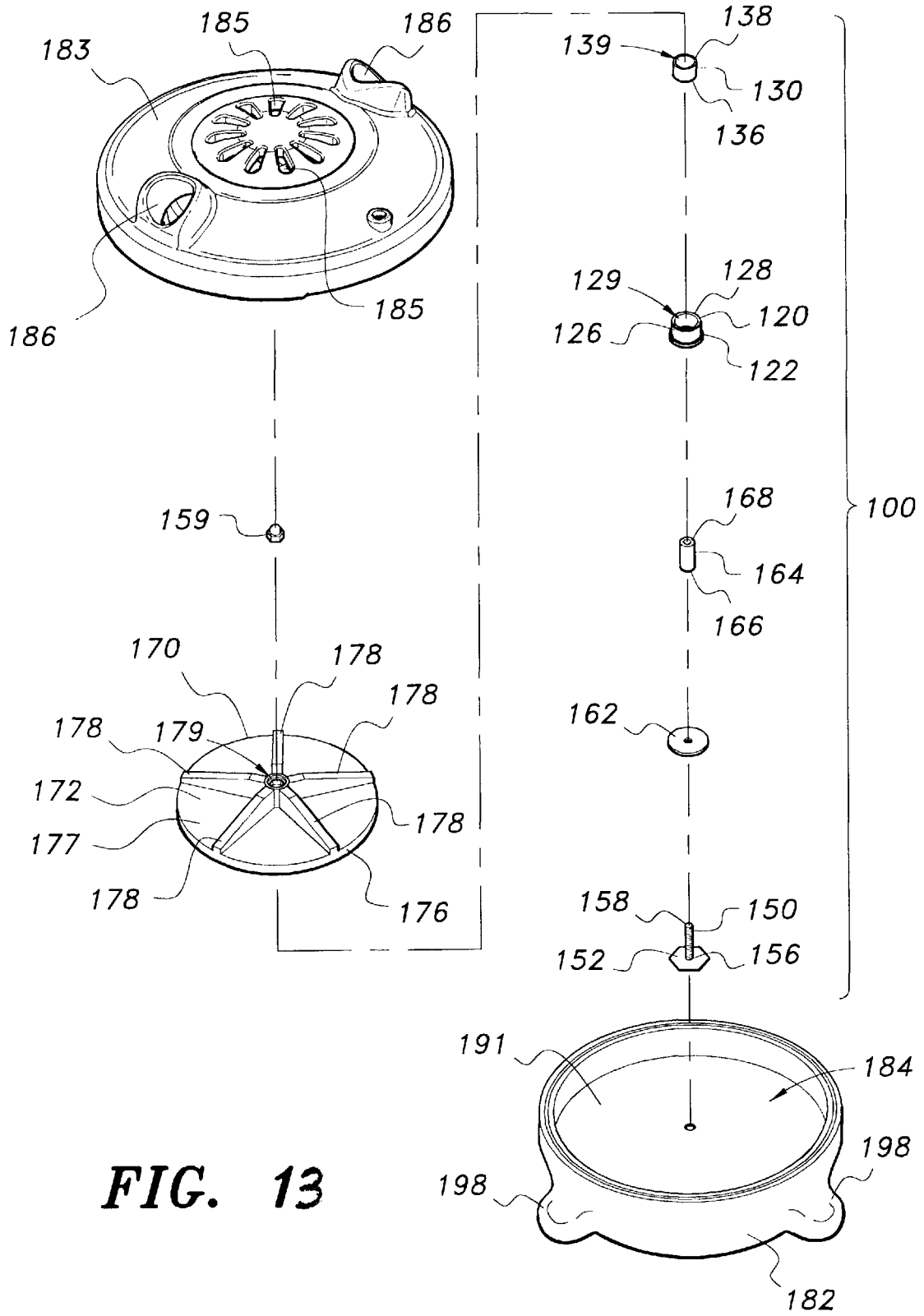
FIG. 13 is an exploded, perspective view of the bearing assembly of FIG. 10, the shaft assembly of FIG. 7, and a jet assembly (with a front or top cover)
Figure 14:
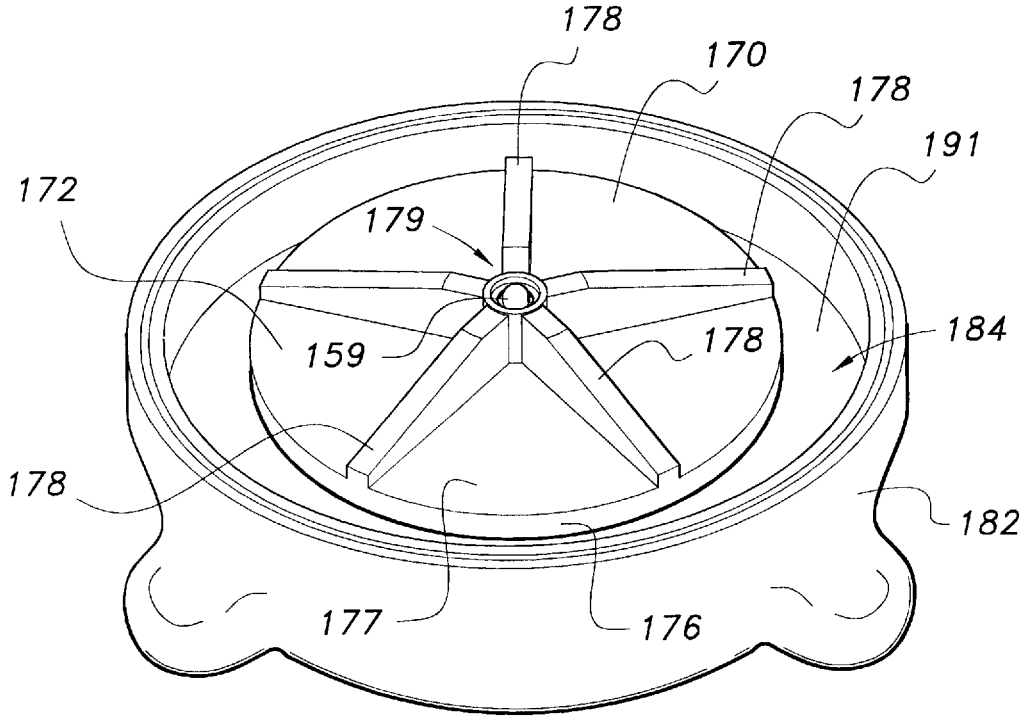
FIG. 14 is an assembly, perspective view of the bearing and shaft assembly of FIGS. 7 and 10, and the impeller and jet assembly housing of the jet assembly (without the front or top cover) of FIG. 13.
Figure 15:
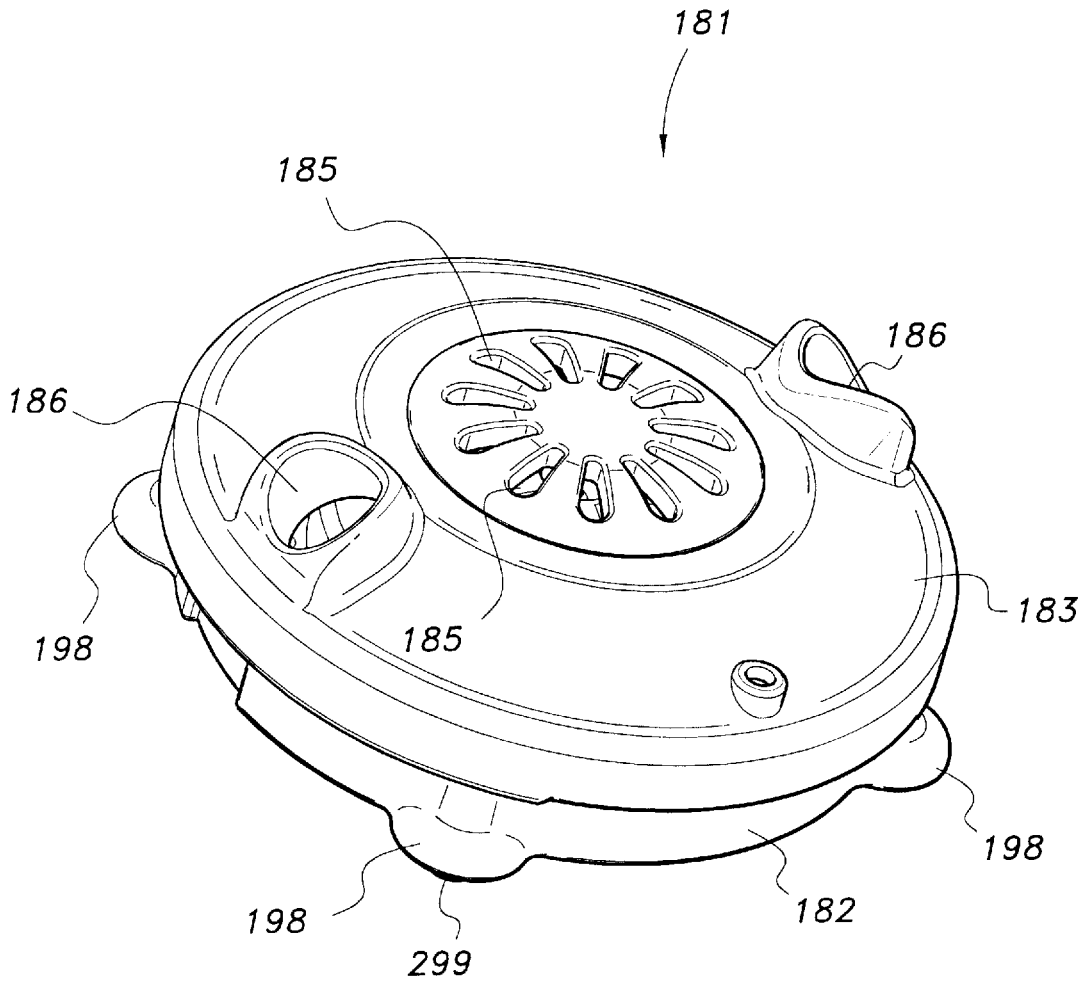
FIG. 15 is an assembly, perspective view of the bearing and shaft assembly of FIGS. 7 and 10, and the impeller and jet assembly housing of the jet assembly (with the front or top cover) of FIG. 13.

As shown in FIGS. 4, 13 and 14, the impeller 170, preferably a magnetic impeller 170 and more preferably a planar magnetic impeller 170, has an outer diameter and a "disc-like" configuration or shape, and includes a front side 172, a rear side 174, a sidewall 176, a circular array of arm members 178 positioned on the front side 172, and the centrally-disposed cavity 179 dimensioned and configured for receiving the outer bearing member 120, inner bearing member 130, shaft member 150, and shaft protection member 160. The centrally-disposed cavity 179 preferably extends from the front side 172 through to the rear side 174. The magnetic impeller 170 is configured to rotate about the shaft member 150 and shaft protection member 160 and to rotate within the impeller-receiving chamber 184. Preferably, the magnetic impeller 170 is formed in whole or in part of a magnetic pole array 177 that, as discussed below, interacts with magnetic pole array 210,910 of the driven magnetic disc assembly 209,900 to rotate the magnetic impeller 170 about the shaft member 150 and shaft protection member 160 such that rotation of the magnetic impeller 170 causes the fluid to flow into the inlet aperture 185 and out the outlet aperture 186. As a non-limiting example, the magnetic impeller 170 may contain a magnetic plate or disk that is preferably substantially or fully enclosed within an exterior preferably made or manufactured of plastic, rubber, a rubber-like material, or any combination thereof. It is obvious to one of ordinary skill in the art that the magnetic impeller 170 may be other types of magnetic impellers that is know in the art. In addition, it is obvious to one of ordinary skill in the art that the exterior of the magnetic impeller 170 may be made or manufactured of any material that is know in the art.

When the top cover 183 of the jet assembly housing 181 is secured to the base 182, it is preferred in a non-limiting example that the vertical distance from a highest point of the impeller arm members 178 to the lowest inlet aperture 185 on the inner surface of the top cover 183 is less than or equal to about half of an inch.

As best shown in FIGS. 17, 23 and 29-32, the motor assembly 200 includes a motor 202,502,503; a driven magnetic disc assembly 209,900 having a magnetic pole array 210,910 such that the motor 202,502,503 is configured to drive the magnetic pole array 210,910; a mounting housing member 250; a gasket 265; a shaft member 150 that is coupled to the magnetic pole array 210,910; and a plurality of screws with wing nuts 258 to support the pump mounting. The mounting housing member 250 and gasket 265 preferably enclose all or a substantial portion of the magnetic pole array 210,910, and help to keep fluids and/or substances or products away from the motor 202,502,503 and magnetic pole array 210,910 so that contamination and/or damage is reduced or prevented. The magnetic pole array 210,910 is formed, constructed, made or manufactured of magnetic material and/or is magnetized in order to generate a magnetic field 212,912.

Figure 17:
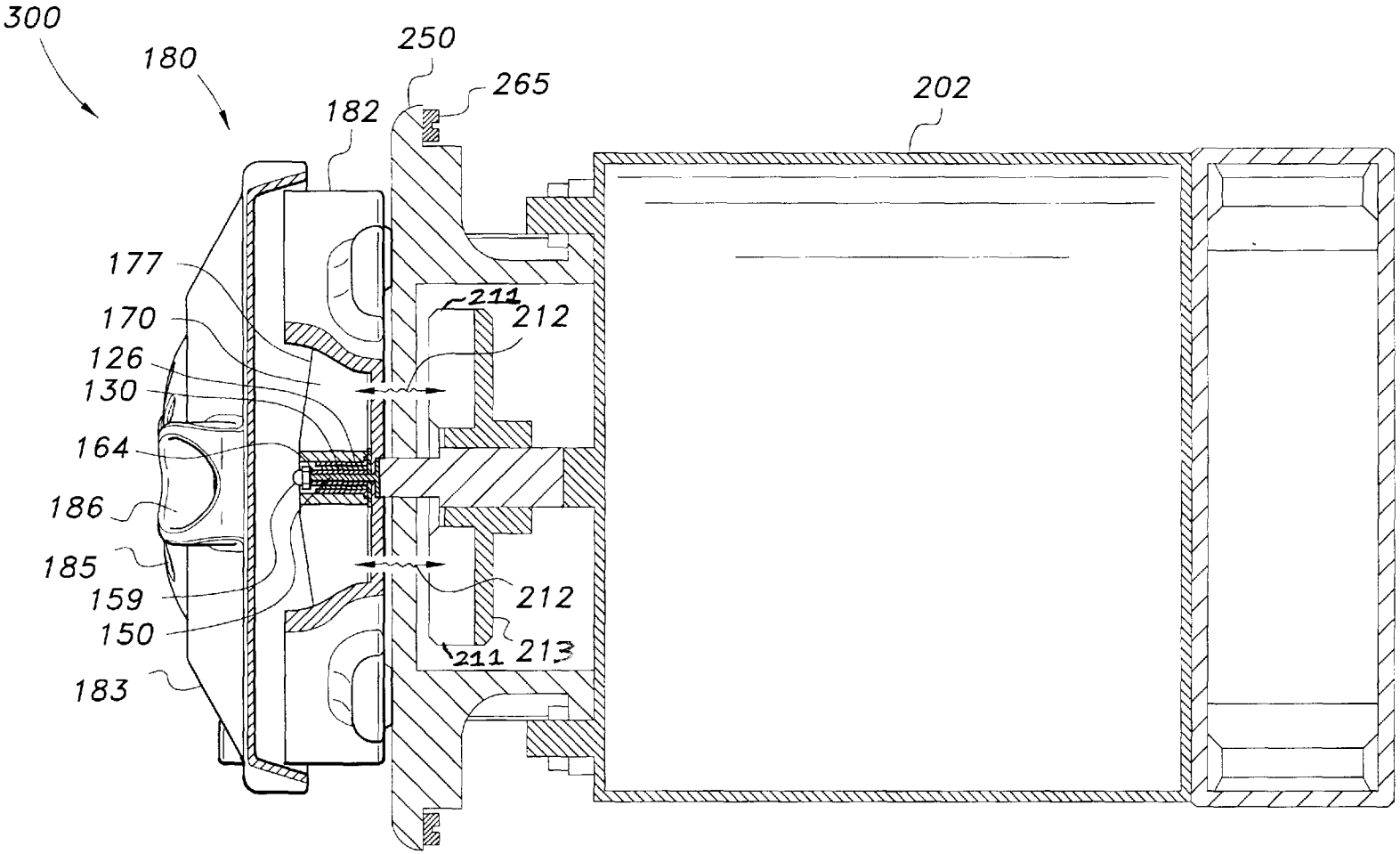
FIG. 17 is a cross-sectional view of the magnetic coupling-type fluid pump of FIG. 16.
Figure 29:
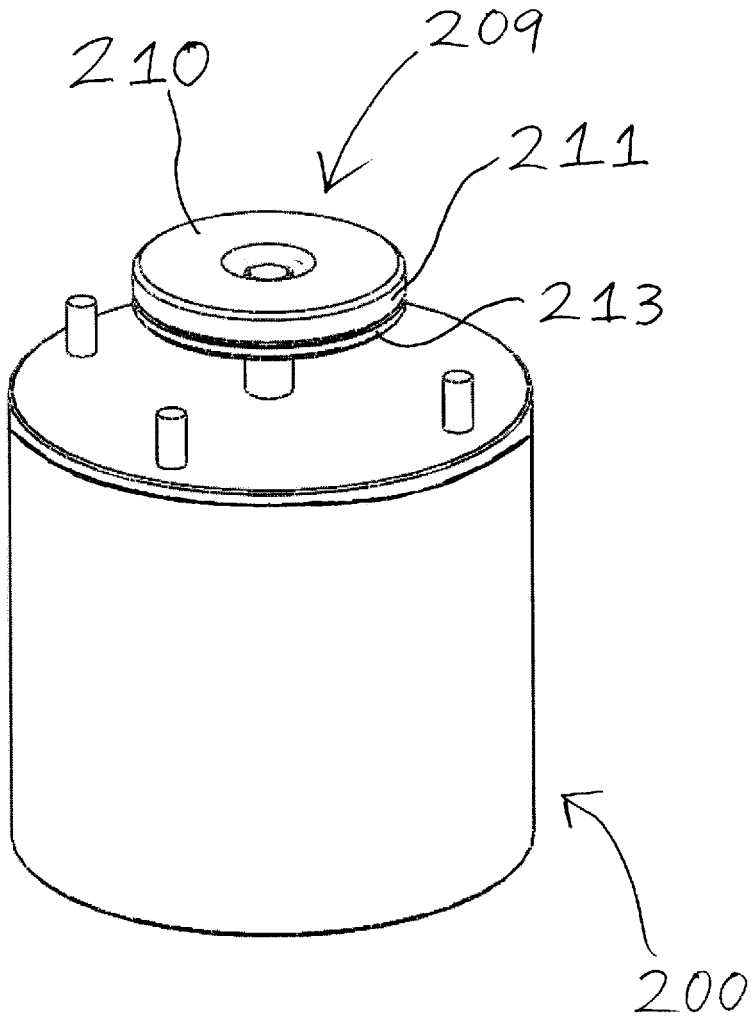
FIG. 29 is a perspective, top view of a driven magnetic disc assembly according to the present invention, showing the driven magnetic disc assembly being secured to a motor.
Figure 30:
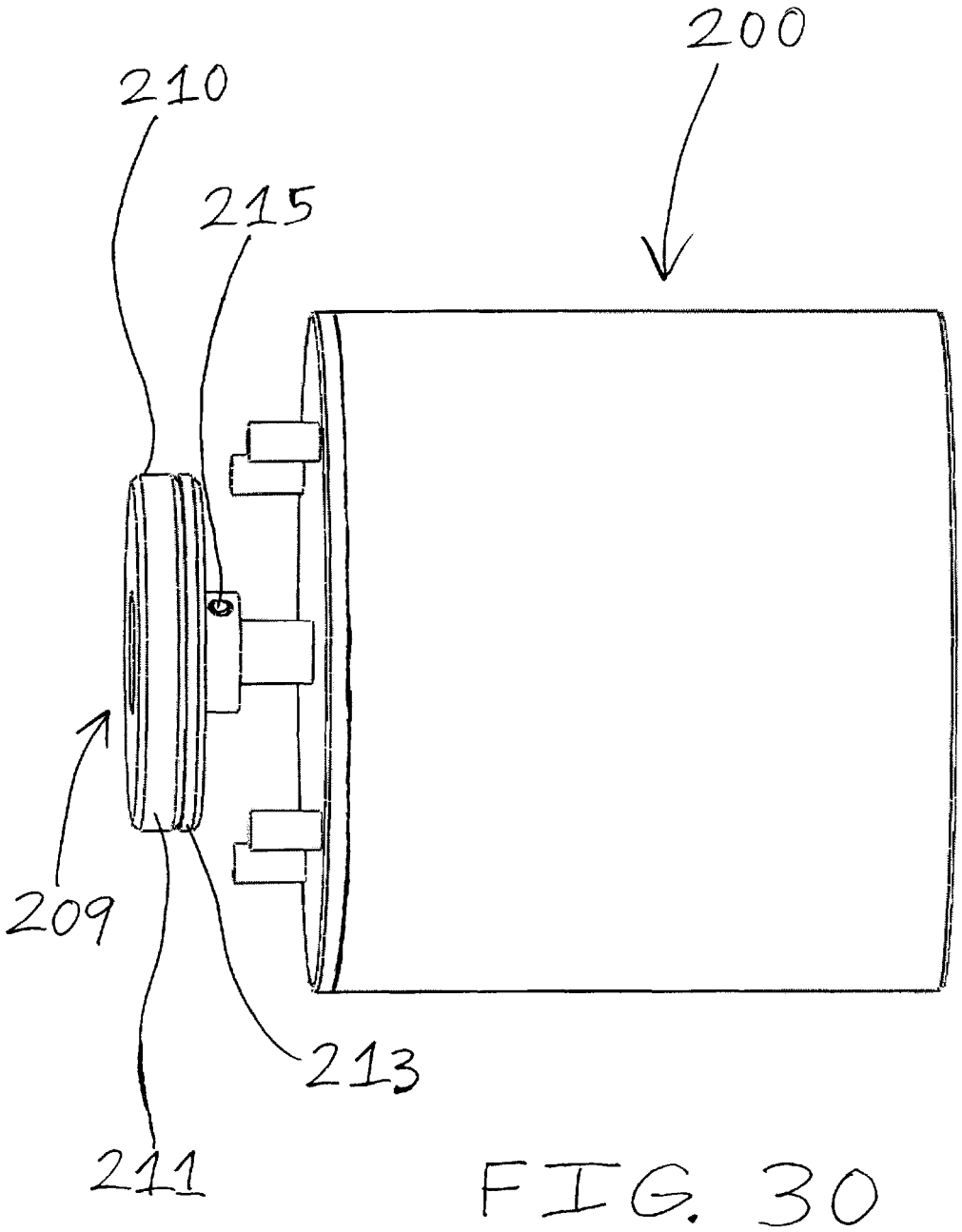
FIG. 30 is a perspective, side view of the driven magnetic disc assembly of FIG. 29.

As a non-limiting example and as best shown in FIGS. 17 and 29-30, the driven magnetic disc assembly 209 comprises a two-layer, magnetic pole array 210 and a motor shaft securing screw 215. The two-layer, magnetic pole array 210 is comprised of a magnetic disc 211 (an upper, thicker layer) and a holder disc 213 (a lower, thinner layer) that are secured to one another by glue or any other means or method known to one of ordinary skill in the art. The magnetic pole array 210 is secured or mounted to the tip of a motor shaft via the holder disc 213 and motor shaft securing screw 215.

Figure 31:
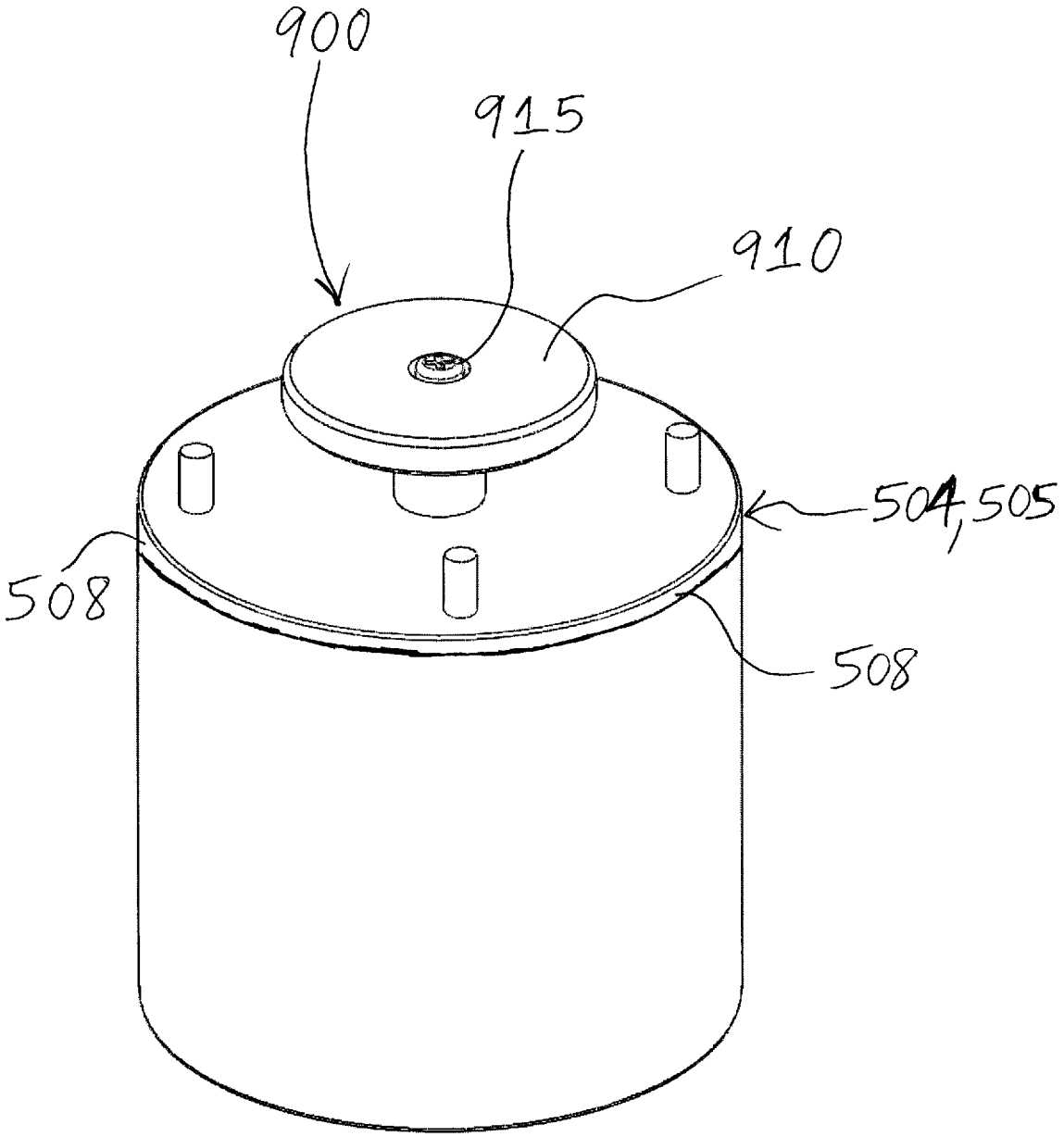
FIG. 31 is a perspective, top view of another driven magnetic disc assembly according to the present invention, showing the driven magnetic disc assembly being secured to a motor.
Figure 32:
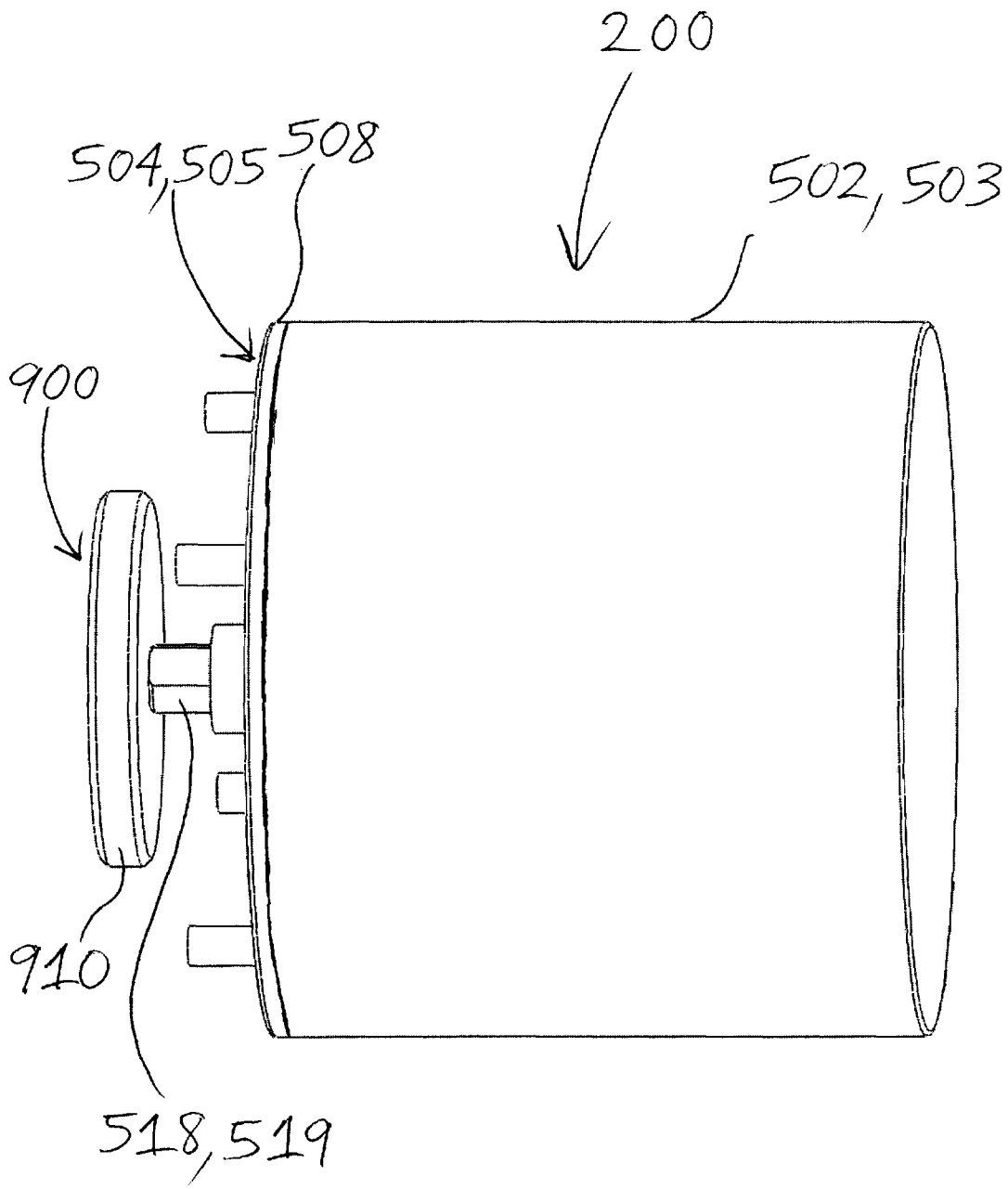
FIG. 32 is a perspective, side view of the driven magnetic disc assembly of FIG. 31.

As another non-limiting example and as best shown in FIGS. 23 and 31-32, the driven magnetic disc assembly 900 comprises a one-layer, magnetic pole array 910 and a motor shaft securing screw 915. The one-layer, magnetic pole array 910 is a magnetic disc. The magnetic pole array 910 is secured or mounted to the tip of a motor shaft 518,519 via the motor shaft securing screw 915. The one-layer, magnetic pole array 910 may be preferred over the two-layer, magnetic pole array 210 when dealing with manufacturing costs and when dealing with heat generated by the motor and vibrations generated from the magnetic coupling when in use or operation.

The motor assembly 200 may include and/or be coupled to a power source 400. Upon operation of the motor assembly 200, the shaft member 150 is preferably stationary and the magnetic field 212,912 generated by the magnetic pole array 210,910 of the driven magnetic disc assembly 209,900 moves or fluctuates in accordance with the rotation of the magnetic pole array 210,910.

Furthermore, the motor assembly 200 may further include an air channel (not shown), or air channel member (not shown). In that regard, the air channel includes an inlet (not shown) and outlet (not shown). The air channel, in part, enables the jet assembly 180 to produce a jet stream of fluid that includes an air mixture.

Figure 5:
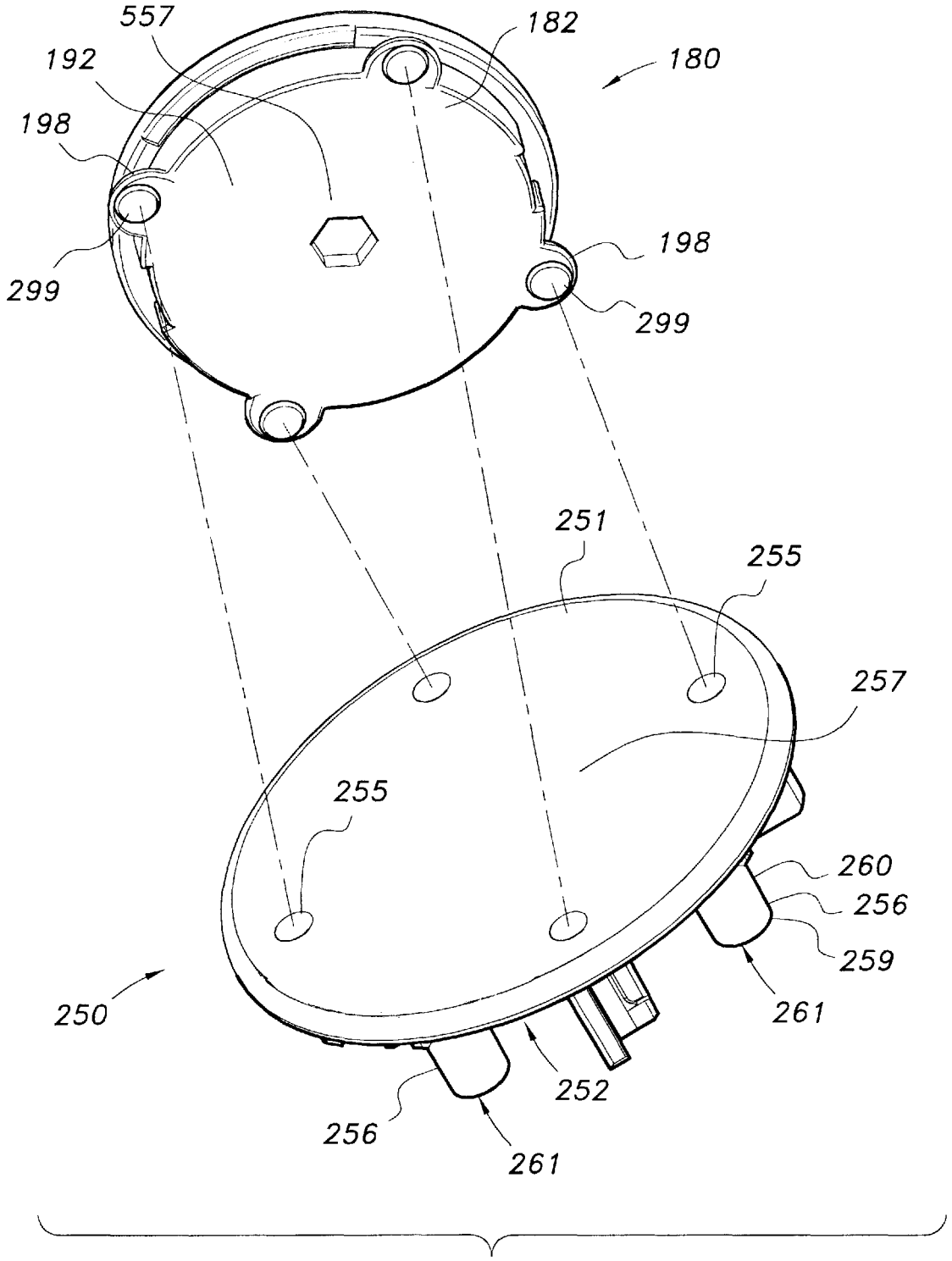
FIG. 5 is an exploded, perspective view of a jet assembly and a mounting housing member or coupling device according to the present invention.
Figure 6:
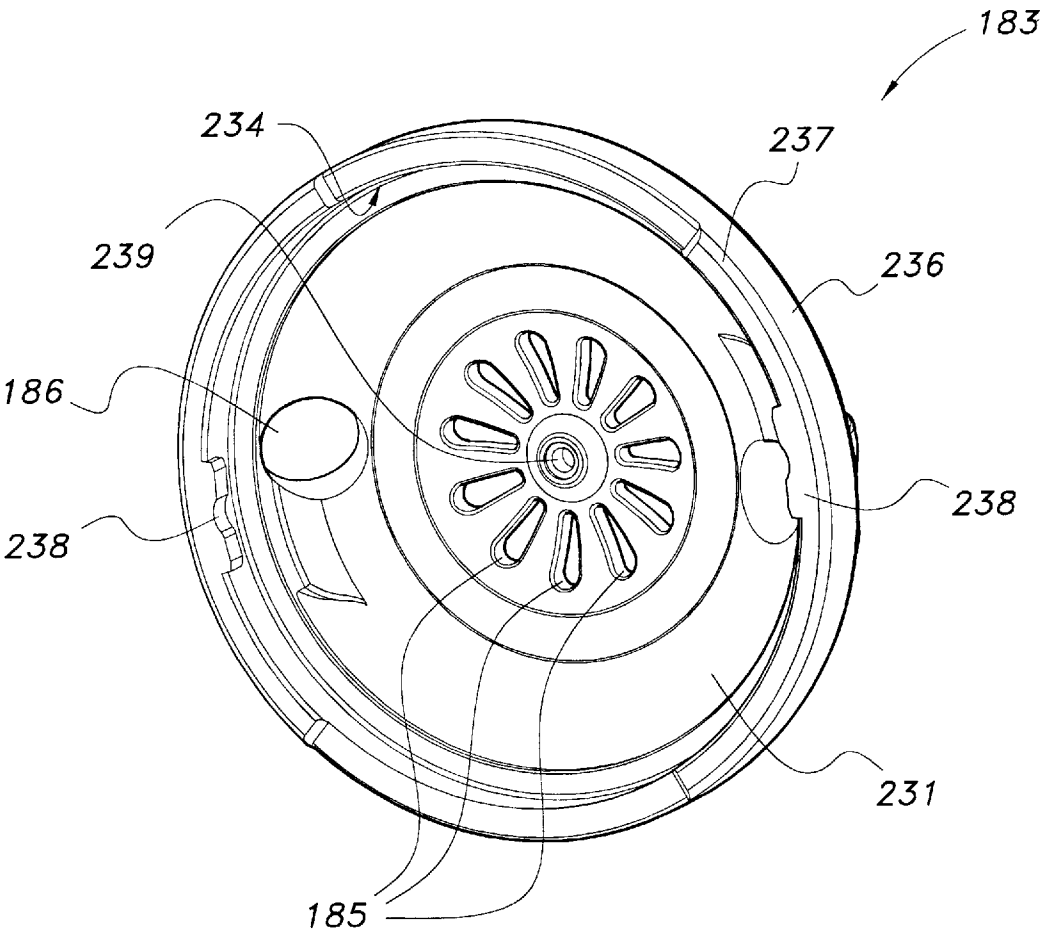
FIG. 6 is a rear, perspective view of a front or top cover of a jet assembly housing according to the present invention, showing an inner surface of the front or top cover.

As best shown in FIGS. 1-5 and 27-28, the mounting housing member 250 helps to secure, attach or couple the jet assembly 180 and motor assembly 200 together, or at least in proximity of one another, such that the jet assembly 180 and motor assembly 200 are in operative communication with one another. The mounting housing member 250 includes a front (or top) side 251, a rear (or bottom) side 252, a plurality of engagement holes or ports 255, a plurality of mounting legs 256 extending rearwardly (or downwardly) from the rear (or bottom) side 252, and at least one wing nut 258. Preferably, the front (or top) side 251 is generally flat or has a generally flat, centrally-located section 257 that allows for a liner 290 to be positioned behind (or below) the base 182 of the jet assembly housing 181 and in front of (or above) the front or top side 251 of the mounting housing member 250 and motor assembly 200, as shown in FIGS. 3-5. Each of the plurality of engagement holes or ports 255 is dimensioned and configured for receiving the corresponding knob 299 that extends rearwardly or downwardly from the corresponding feet extension 198 of the base 182 of the jet assembly housing 181. The securement, attachment or engagement of the knobs 299 of the plurality of feet extensions 198 to or inside the plurality of engagement holes or ports 255 of the mounting housing member 250 prevents the rotation of the base 182 and front or top cover 183 of the jet assembly housing 181 when the pump 10,300,800 is in operation, and thus form a jet assembly rotation locking mechanism. Each of the plurality of mounting legs 256 has a first end 259, a second end 260, and a hollow channel 261 extending from the first end 259 toward the second end 260. Each hollow channel 261 is dimensioned and configured for receiving a corresponding screw (not shown) of a plurality of screws when the motor assembly 200 is to be secured to the mounting housing member 250. Preferably, the wing nut 258 rotates to extend out to provide a lock for the securement or installation of the mounting housing member 250 and motor assembly 200 to one another. The plurality of screws and wing nut 258 secure or attach the mounting housing member 250 and motor assembly 200 to one another when the user screws or tightens the screws into the hollow channel 261 of the mounting legs 256 and rotates the wing nut 258. The tightening of the the screws into the hollow channel 261 of the mounting legs 256 and rotation of the wing nut 258 causes pressure to be applied to the gasket or seal 265 such that a strong seal will form between the gasket or seal 265 and contact surface of the setting SET. The mounting housing member 250 may be made or manufactured of plastic, hard plastic, and/or any other suitable material known to one of ordinary skill in the art. Preferably, the mounting housing member 250 is made or manufactured of a plastic material to allow for magnetic field penetration from the motor assembly 200, without any, or with minimal, magnetic field loss. This allows for a magnet or magnets of smaller size, in comparison to a magnet or magnets needed when the mounting housing member 250 is made or manufactured of a non-plastic material, to be used, and, thus, reducing cost for magnets.

Figure 27:
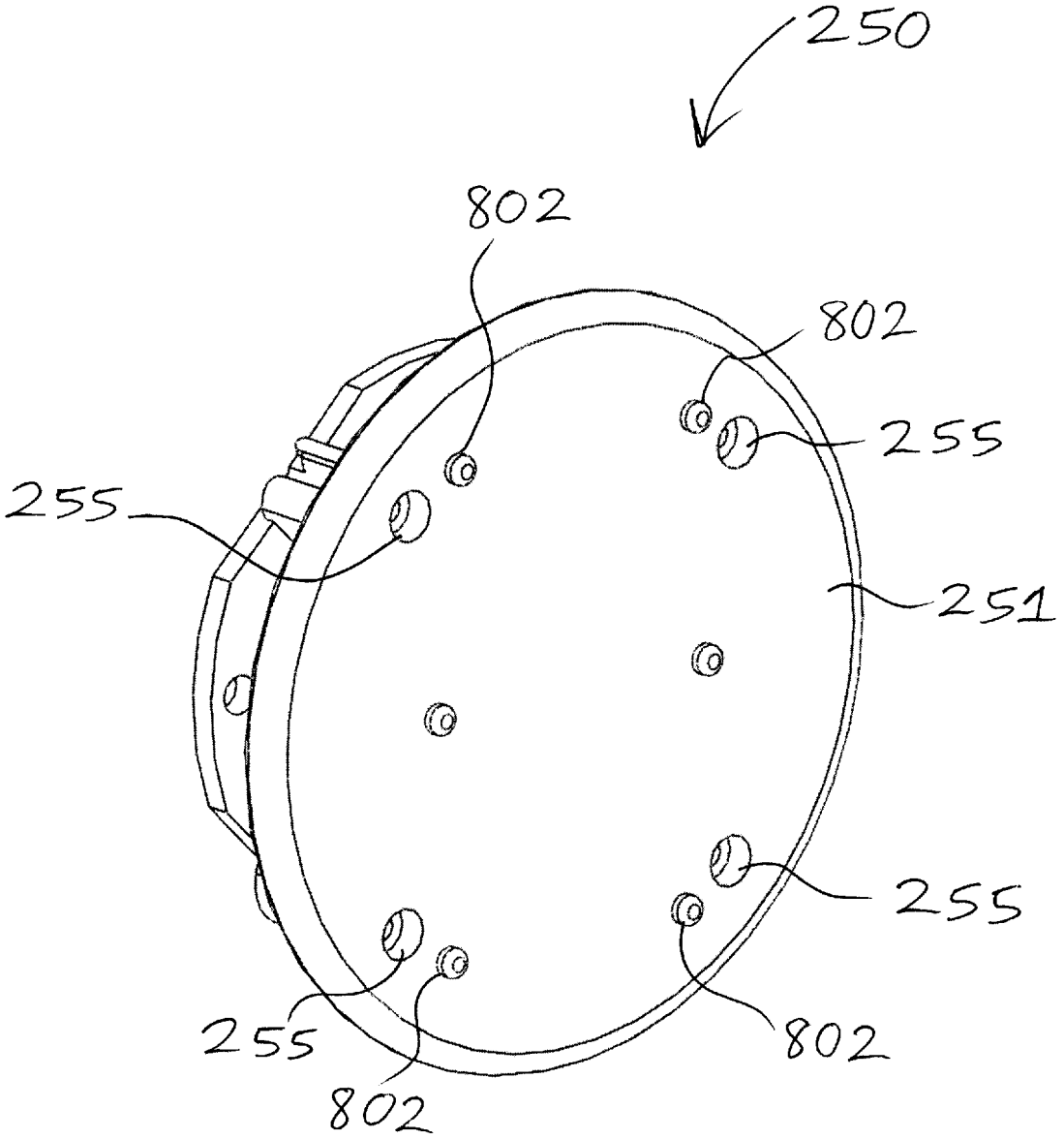
FIG. 27 is a perspective view of the mounting housing member of FIG. 5, with the addition of a plurality of nipples positioned at predetermined locations.
Figure 28:
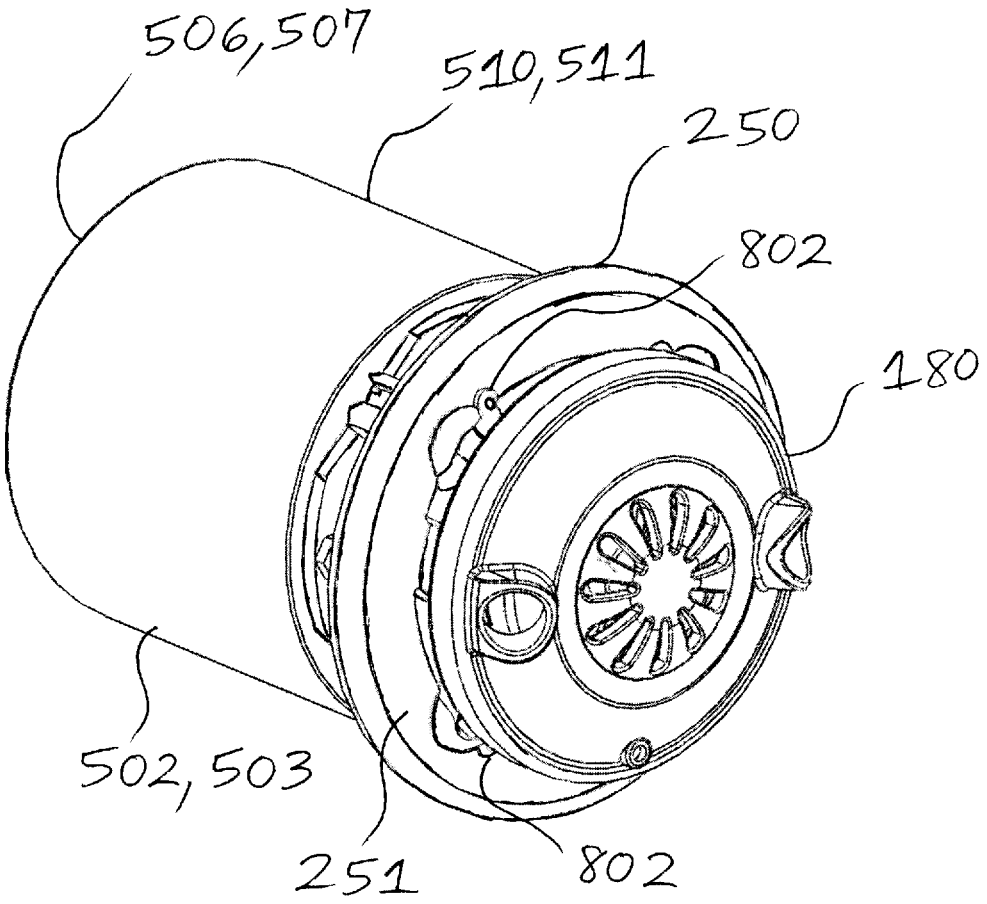
FIG. 28 is a perspective view of a fluid pump according to the present invention, showing a jet assembly, the mounting housing member of FIG. 27, and a motor being secured to one another.

As an alternative to, or in addition to, the combination of the knobs 299 and engagement holes or ports 255 in forming a jet assembly rotation locking mechanism, at least one nipple 802, preferably a plurality of nipples 802, may be positioned at, or secured or attached to, predetermined locations (as shown in FIGS. 27 and 28) on the front (or top) side 251 of the mounting housing member 250 such that they form, or help form when combined with the knobs 299 and engagement holes or ports 255, a jet assembly rotation locking mechanism.

Figure 2:
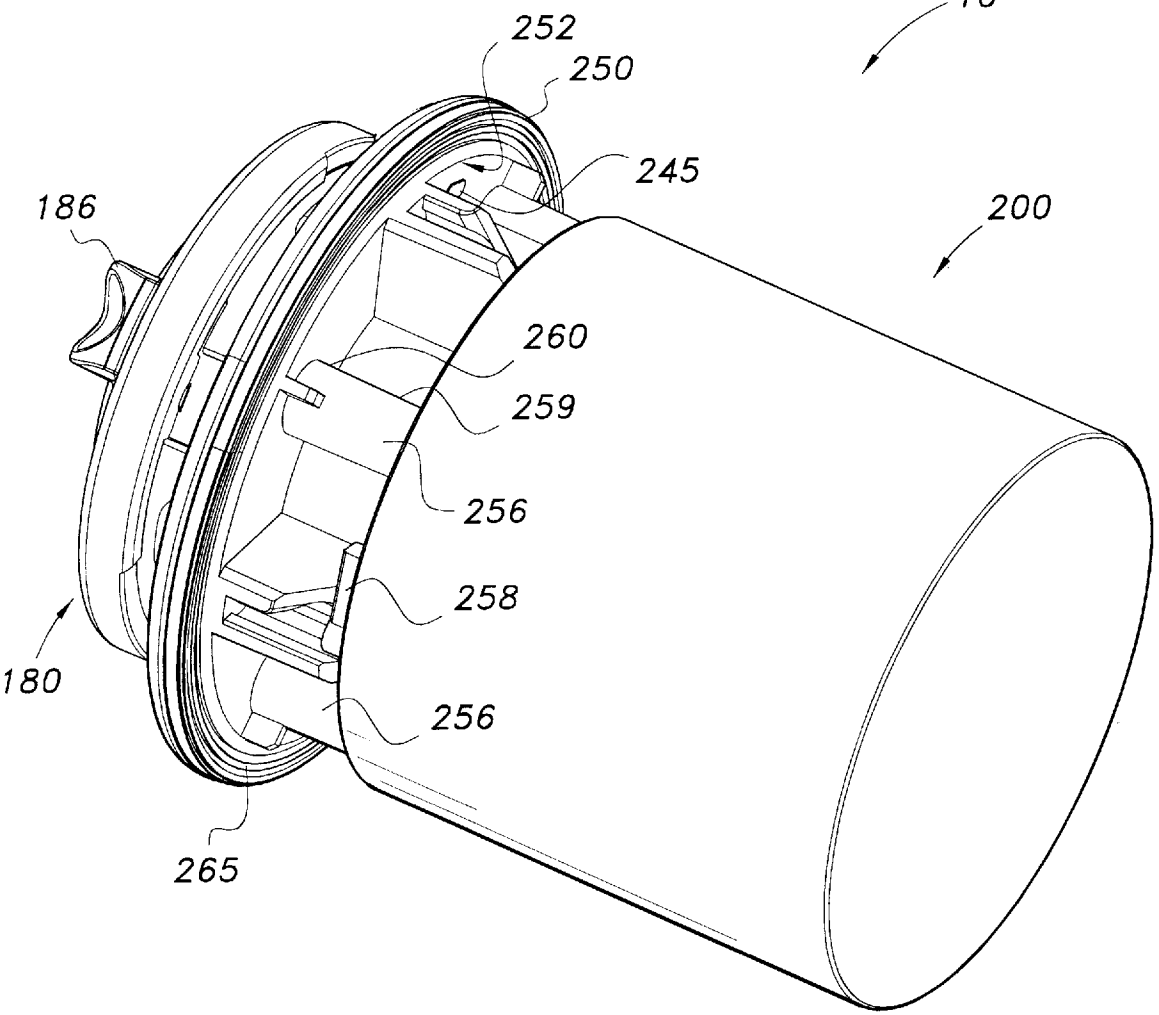
FIG. 2 is a rear, left side, perspective view of the fluid pump of FIG. 1.

As shown in FIG. 2, the gasket or seal 265, preferably a ring-shaped or ring-type gasket, acts or serves as a fluid or water seal to prevent fluid or water from getting past the contact surface of the setting SET and making contact with the motor assembly 200 during use of the pump 10. As shown in FIG. 3, the gasket 265 is secured to and positioned below (or behind) and adjacent to the rear or bottom side 252 of the mounting housing member 250 and above (or in front of) and adjacent to the contact surface of the setting SET. Preferably, the gasket 265 is made or manufactured of a rubber material.

As a non-limiting example and as best shown in FIG. 3, the liner 290, preferably a disposable liner 290, may be included with the pump 10 or may be provided by an operator or user of the setting SET. The liner 290 is positioned between the base 182 of the jet assembly housing 181 and the mounting housing member 250. The liner 290 helps to provide proper or adequate hygiene for customers or users. Preferably, the disposable liner 290 is made or manufactured of a plastic material or any other material known to one of ordinary skill in the art. If the liner 290 is not a disposable version, then it is preferred that the liner 290 is made or manufactured of a material that is easily washed or cleaned, or any other material known to one of ordinary skill in the art.

Figure 18:
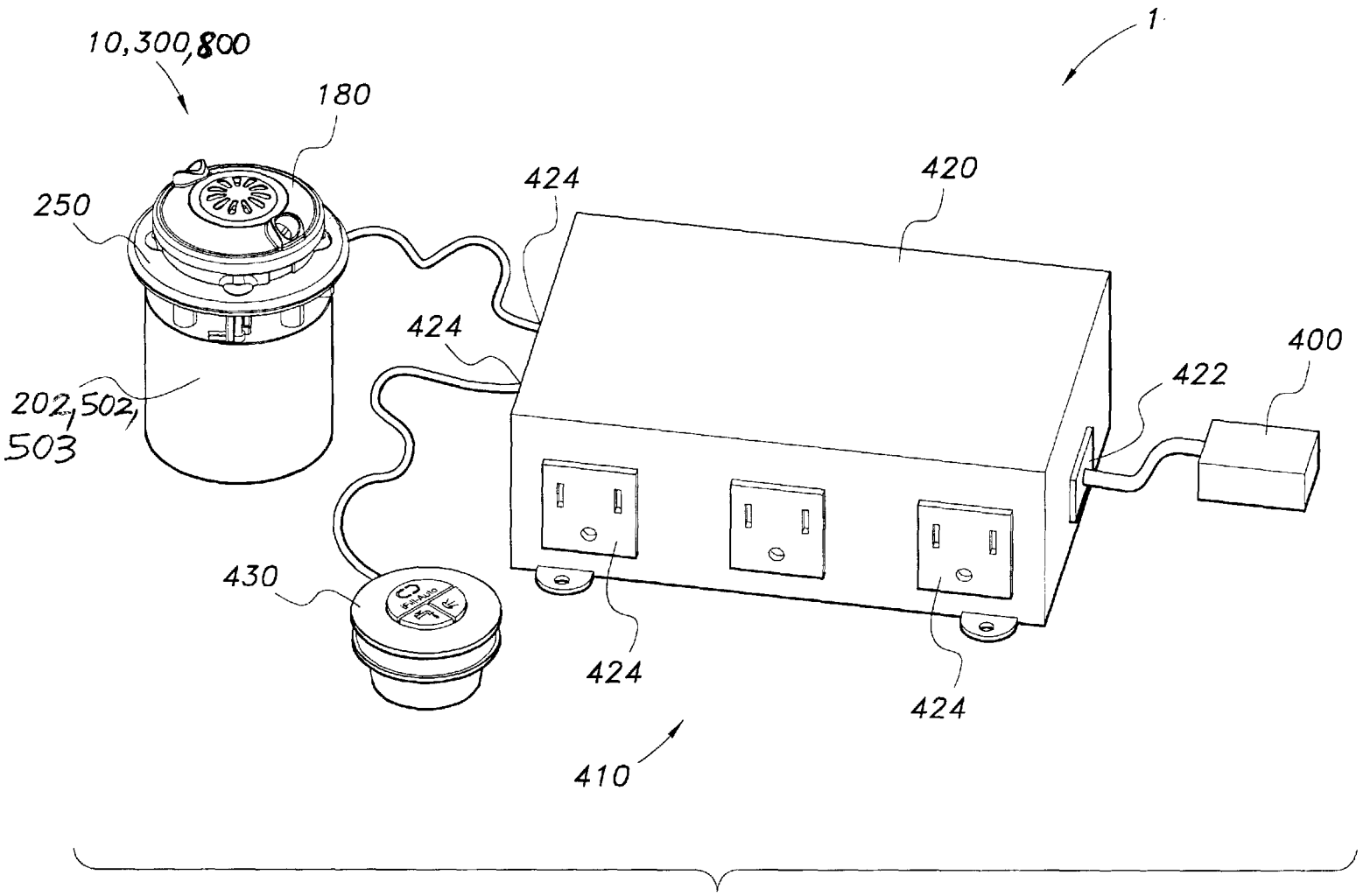
FIG. 18 is a perspective view of a fluid pump apparatus according to the present invention, showing a fluid pump and a control device or keypad being connected to a control box.

As shown in FIG. 18, the power source 400 provides power to the pump 10,300,800, and preferably provides power to the motor 202 of the motor assembly 200 of the pump 10,300,800 to drive the impeller 170. As a non-limiting example, the power source 400 may be AC power input, at least one battery, or any power source known to one of ordinary skill in the art. As shown in FIG. 18, the motor 202,502,503 may be connected to the power source 400 via the control box 420 of the control apparatus 410.

As shown in FIG. 18, the control apparatus 410 preferably includes the control box 420 and a control keypad or device 430. The control box 420 preferably includes at least one inlet 422 for being in operative communication with the power source 400, and multiple outlets 424 for being in operative communication with the pump 10,300,800 and control keypad or device 430. The control keypad or device 430 preferably acts as a remote control device to be able to turn the pump 10,300,800 on and off. In addition, it is preferred that the control keypad or device 430 is operable to control at least one of the intensity, color, illumination sequencing, and any combination thereof for the array of LED light members 275.

As best shown in FIGS. 7-13, the bearing and shaft assembly 100 is comprised of a bearing assembly 110 comprising an outer bearing member 120 and an inner bearing member 130, and a shaft assembly 140 comprising a shaft member 150, a shaft protection member 160, and a locking mechanism 159.

As shown in FIGS. 10-13, the outer bearing member 120 and inner bearing member 130 perform as a bearing. The inner bearing member 130 absorbs vibration and noise when in use with other components of the jet assembly 180.

Figure 12:
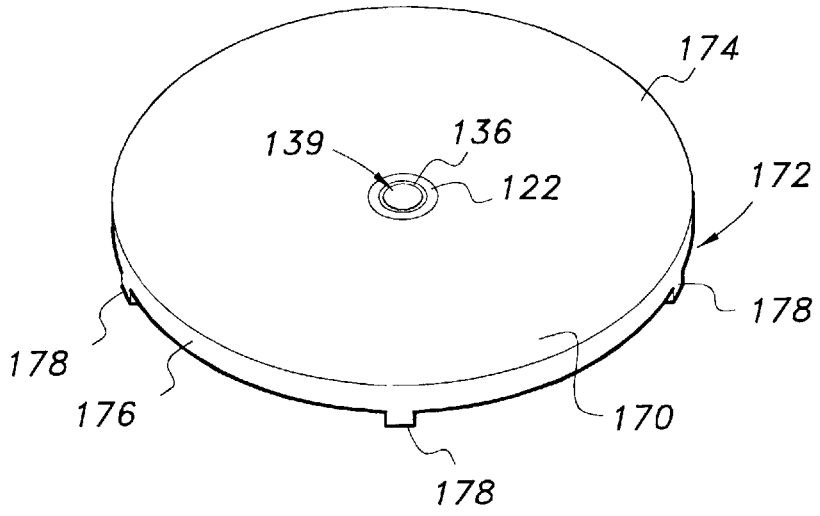
FIG. 12 is an assembly, perspective view of the bearing assembly of FIG. 10 positioned within a cavity of an impeller.

The outer bearing member 120 includes a base 122, preferably a ring-like base, and a cylindrical body 124 extending upwardly from the ring-like base 122. The ring-like base 122 has a predetermined thickness. The cylindrical body 124 has a first end 126, a second end 128, and a cavity 129 extending from the first end 126 to the second end 128. As shown in FIGS. 10-13, the cavity 129 is dimensioned and configured for receiving the inner bearing member 130. Preferably, when in use, the outer bearing member 120 and inner bearing member 130 are closely or tightly positioned relative to one another such that they form an effective seal. As shown in FIGS. 12 and 13, the outer bearing member 120 is dimensioned and configured for fitting, preferably closely or tightly fitting, within a centrally-disposed cavity 179 of the impeller 170, preferably a magnetic impeller and more preferably a planar magnetic impeller, of the jet assembly 180. Preferably and as best shown in FIG. 12, the ring-like base 122 of the outer bearing member 120 and first end 136 of the cylindrical body 134 of the inner bearing member 130 are substantially flush with the rear side 174 of the magnetic impeller 170 when the outer bearing member 120 and inner bearing member 130 are positioned within the centrally-disposed cavity 179 of the magnetic impeller 170. Preferably, the centrally-disposed cavity 179 of the magnetic impeller 170 is dimensioned and configured for effectively receiving the bearing assembly 110 prior to use, and also for effectively retaining the bearing assembly 110 when in use. The outer bearing member 120 is preferably made or manufactured of a plastic material or engineered plastics. It is obvious to one of ordinary skill in the art that other suitable materials may be used in the making or manufacturing of the outer bearing member 120.

The inner bearing member 130 includes cylindrical body 134 having first end 136, a second end 138, and a cavity 139 extending from the first end 136 to the second end 138. As shown in FIGS. 10-13, the cavity 139 is dimensioned and configured for receiving the shaft member 150 and shaft protection member 160 of the shaft assembly 140. The inner bearing member 130 is preferably made or manufactured of rubber or a rubber-like material. It is obvious to one of ordinary skill in the art that other suitable materials may be used in the making or manufacturing of the inner bearing member 130.

Figure 9:
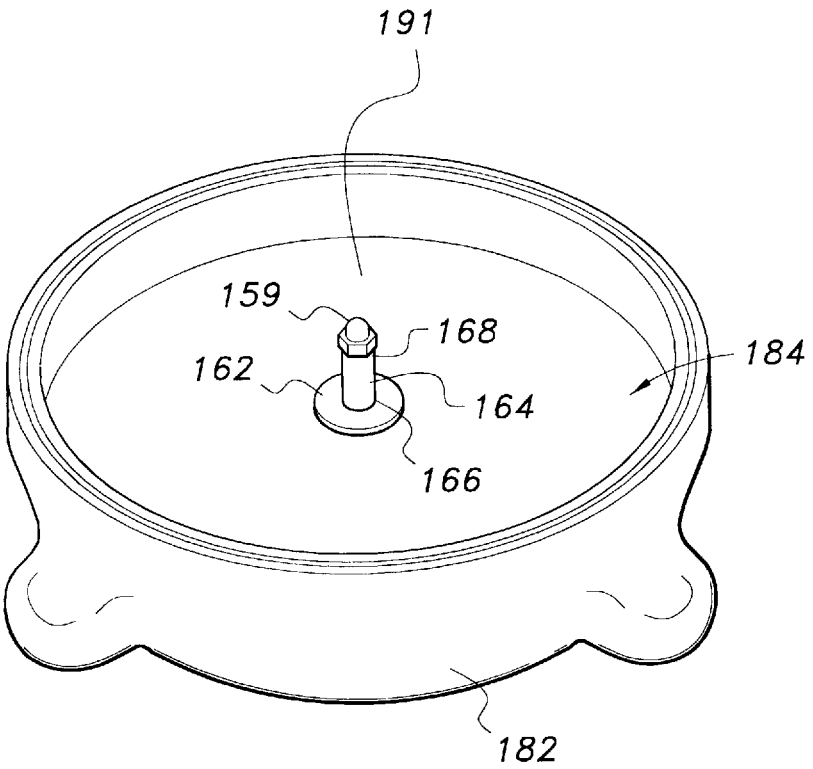
FIG. 9 is an assembly, perspective view of the shaft assembly of FIG. 7 positioned relative to a jet assembly housing (without a front or top cover) of a jet assembly.
Figure 10:
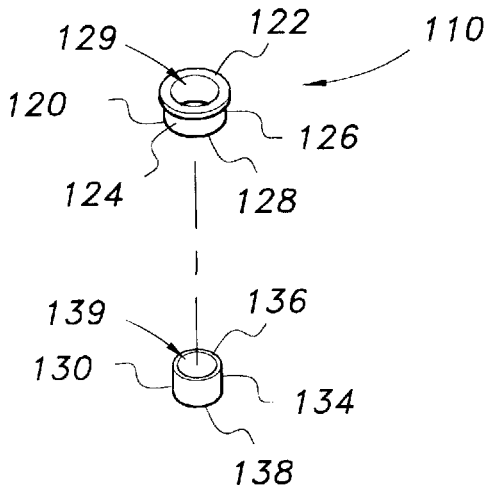
FIG. 10 is an exploded, perspective view of a bearing assembly of a bearing and shaft assembly according to the present invention.
Figure 11:
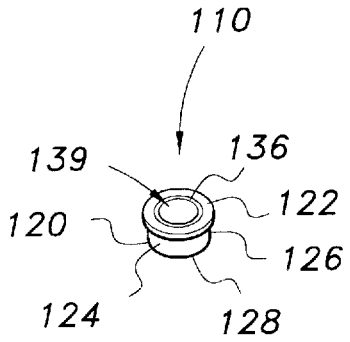
FIG. 11 is an assembly, perspective view of the bearing assembly of FIG. 10.

As shown in FIGS. 7-9 and 13, the shaft member 150 includes a base 152 and a cylindrical body 154 extending upwardly from the base 152. The cylindrical body 154 has a first end 156 and a second end 158. As best shown in FIG. 9, the shaft member 150 and shaft protection member 160 are secured, attached, fixed or mounted within the housing 181, preferably in a central location upon the inner surface 191 of the base 182 of the housing 181, of the jet assembly 180 via the base 152 of the shaft member 150 being secured, attached, fixed or mounted to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

The shaft protection member 160 includes a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 7, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface. Further, the shaft protection member 160 is preferably made or manufactured as two pieces. It is obvious to one of ordinary skill in the art that the shaft protection member 160 may be made or manufactured as a single piece.

The locking mechanism 159 secures the impeller 170, preferably the magnetic impeller 170, within the housing 181 of the jet assembly 180. The locking mechanism 159 may be a locking nut that, when in use, is secured onto the second end 158 of the cylindrical body 154 of the shaft member 150.

Figure 16:
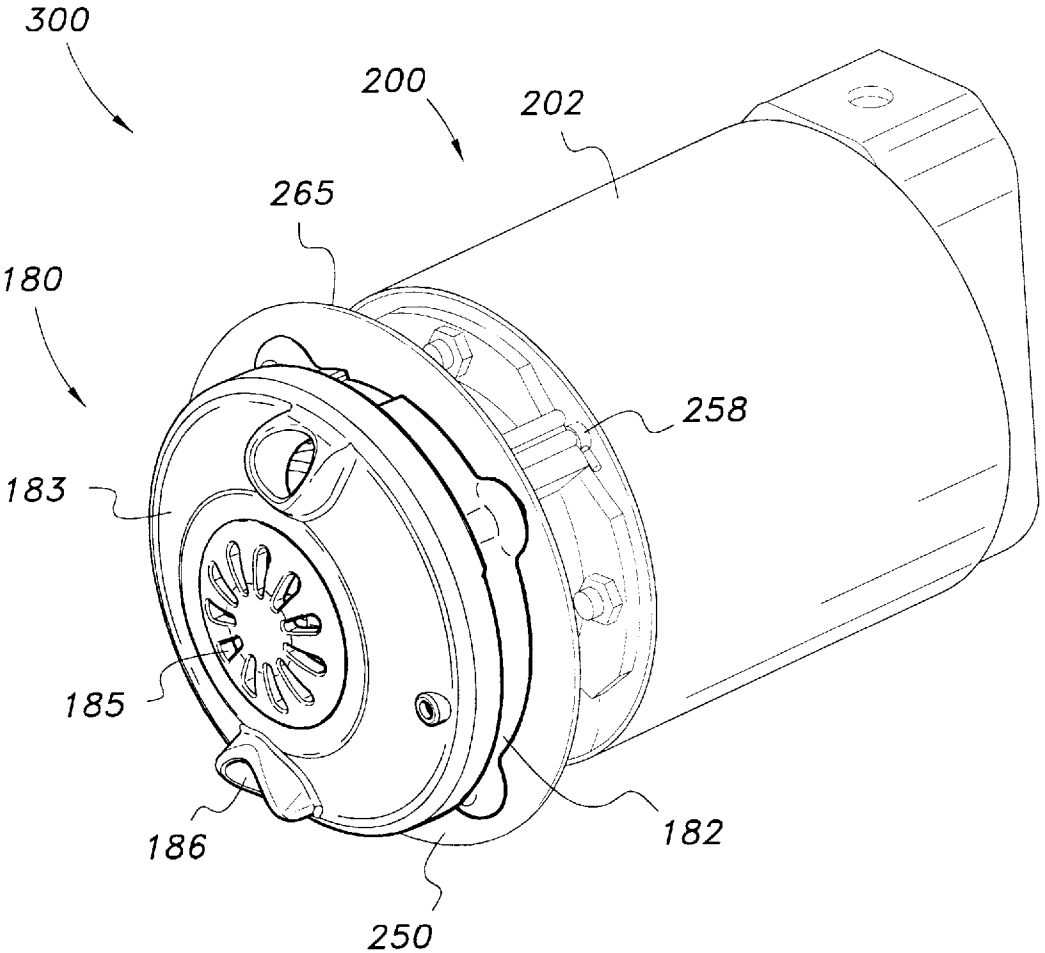
FIG. 16 is a perspective view of a magnetic coupling-type fluid pump according to the present invention, showing a jet assembly and a motor assembly secured or coupled to or about one another.

In addition, when the magnetic coupling-type fluid pump 300,800 is assembled as shown in FIGS. 16 and 17, the jet assembly 180 is positioned adjacent or in close proximity to the mounting housing member 250 and motor assembly 200. The jet assembly 180 is preferably magnetically coupled to the motor assembly 200 when the jet assembly 180 is positioned adjacent or in close proximity to the mounting housing member 250. The jet assembly 180 and mounting housing member 250 can be secured or coupled to one another by any method and/or device known to one of ordinary skill in the art.

In operation or use and as shown in FIGS. 5 and 9-13, the base 152 of the shaft member 150 and base 162 of the shaft protection member 160 may be secured, attached, fixed or mounted preferably in a central location upon the inner surface 191 of the base 182 of the housing 181 of the jet assembly 180 of the magnetic coupling-type fluid pump 10,300,800. The bearing assembly 110 may then be positioned in the cavity 179 of the magnetic impeller 170, which can then be positioned within the impeller-receiving chamber 184 of the housing 181 of the jet assembly 180. The locking mechanism or nut 159 can then be secured to the second end 158 of the cylindrical body 154 of the shaft member 150 to secure the magnetic impeller 170 within the housing 181 of the jet assembly 180.

Preferably when in operation or use and as shown in FIGS. 16 and 17, the jet assembly 180 is positioned adjacent or in close proximity to the motor assembly 200 when the magnetic coupling-type fluid pump 10,300,800 is fully assembled. In that regard, the jet assembly 180 is preferably magnetically coupled to the motor assembly 200 when the jet assembly 180 is positioned adjacent or in close proximity to the motor assembly 200. Specifically, the magnetic pole array 210,910 of the driven magnetic disc assembly 209,900 and the magnetic pole array 177 of the impeller 170 magnetically couple together the motor assembly 200 and the jet assembly 180.

Moreover, during operation of the motor assembly 200, the shaft member 150 is preferably stationary and the magnetic field 212,912 generated by the magnetic pole array 210,910 of the driven magnetic disc assembly 209,900 moves or fluctuates in accordance with the rotation of the magnetic pole array 210,910 of the driven magnetic disc assembly 209,900. This moving or fluctuating magnetic field 212 moves and/or causes rotation of magnetic pole array 177 of the magnetic impeller 170. Additionally, as discussed in greater detail below, rotation of the magnetic impeller 170 results in fluid being drawn towards the magnetic impeller 170 through inlet apertures 185 and such fluid to be propelled out of the jet assembly 180 through the outlet aperture 186.

It is to be understood that the present invention is not limited to the embodiments and non-limiting examples described above or as shown in the attached figures, but encompasses any and all embodiments within the spirit of the invention.

What is claimed is:

1. A magnetic coupling fluid pump for dispensing a fluid into a setting or work environment in manicure and pedicure industries, said magnetic coupling fluid pump comprising:

a jet assembly comprising a jet assembly housing, a motor comprising a rotor, a motor shaft, and a bearing, a motor cap comprising a fluid sealing member, and a mounting housing member, wherein a wall of said fluid sealing member comprises a first end, a second end, a flange, and an axial body surrounding the motor shaft of the motor, wherein said first end of wall extending from an outermost surface of the motor cap towards the mounting housing member in a direction transverse to the motor cap and terminating at the second end, the flange extending from said second end in a direction transverse to the wall;

wherein said motor cap comprises a bearing holder which receives the bearing, said bearing holder extending toward the rotor, wherein said wall, flange, bearing holder, and motor cap all are monolithically formed;

wherein said wall is in contact with the motor shaft from said first end to said second end of said wall;

wherein the mounting housing member supports the motor.

2. The magnetic coupling fluid pump according to claim 1, wherein said motor is a one-hole motor.

3. The magnetic coupling fluid pump according to claim 1, wherein said motor cap is located at a first end of said motor.

4. The magnetic coupling fluid pump according to claim 1, wherein a motor shaft hole is located on said motor cap.

5. The magnetic coupling fluid pump according to claim 1, wherein said motor cap is located at a first end of said motor.

6. The magnetic coupling fluid pump according to claim 1, further comprising a driven magnetic disc assembly that comprises a one-layer, magnetic disc and motor shaft securing element, wherein said motor shaft securing element is for securing said one-layer, magnetic disc to a tip of said motor shaft of said one-hole motor, wherein, during operation, said one-layer, magnetic disc generates a magnetic field that moves or fluctuates in accordance with rotation of said one-layer, magnetic disc, wherein said moving or fluctuating magnetic field moves and/or causes rotation of a magnetic impeller of the jet assembly, and wherein, during operation, rotation of the magnetic impeller results in fluid being drawn into the jet assembly through at least one inlet aperture and such fluid to be propelled out of the jet assembly through at least one outlet aperture.

7. The magnetic coupling fluid pump according to claim 6, wherein said motor shaft securing element is a securing screw.

8. The magnetic coupling fluid pump according to claim 1, wherein, during operation, said motor shaft and said motor are positioned outside of the setting or work environment.

9. A spa tub in manicure and pedicure industries comprising:

a basin that is configured for mounting a magnetic coupling fluid pump; and said magnetic coupling fluid pump comprising a jet assembly, a motor, a motor cap, and a mounting housing member, wherein said motor cap comprises a fluid sealing member and a bearing holder, wherein said motor cap partially defines a housing of the motor, wherein a wall of said fluid sealing member comprises a first end, a second end, a flange, and an axial body surrounding a motor shaft of the motor, wherein said first end of wall extending from an outermost surface of the motor cap toward the mounting housing member and in a direction transverse to the motor cap and terminating at the second end, the flange extending from said second end in a direction transverse to the wall, wherein said bearing holder extends toward a rotor of the motor, wherein said wall, flange, bearing holder, and motor cap all are monolithically formed, and wherein said wall is in contact with the motor shaft from said first end to said second end of said wall; and wherein the mounting housing member supports the motor.

10. The spa tub according to claim 9, wherein said wall extends from a motor side surface of said mounting housing member toward said motor.

11. The spa tub according to claim 10, wherein said mounting housing member further comprises a plurality of mounting legs.

12. The spa tub according to claim 11, wherein at least one mounting leg of said plurality of mounting legs is dimensioned and configured for receiving a wing nut.

13. The spa tub according to claim 9, wherein said second end has a ring-shaped configuration.

14. The spa tub according to claim 9, wherein said body has a cylindrical configuration, and wherein said second end has a ring-shaped configuration.

15. The spa tub according to claim 9, wherein said wall is manufactured of a material selected from the group consisting of plastic, engineered plastics, and a combination thereof.

16. The spa tub according to claim 9, wherein each of said first end, said second end, and said body further comprises a diameter.

17. The spa tub according to claim 9, wherein said jet assembly further comprises an impeller that comprises an outer diameter.

18. The spa tub according to claim 9, wherein said mounting housing member further comprises a gasket.

19. The spa tub according to claim 9, wherein said jet assembly further comprises a shaft assembly.

20. The spa tub according to claim 19, wherein said shaft assembly is secured to said base of said jet assembly housing.

21. The spa tub according to claim 19, wherein said shaft assembly comprises a shaft member and a shaft protection member.

22. The spa tub according to claim 21, wherein said shaft protection member comprises a base.

23. The spa tub according to claim 22, wherein said base of said shaft protection member is manufactured of a ceramic material.

24. The spa tub according to claim 9, wherein said jet assembly further comprises a bearing assembly.

25. The spa tub according to claim 24, wherein said bearing assembly is secured to a center of an impeller.

26. The spa tub according to claim 24, wherein said bearing assembly comprises an outer bearing member.

27. The spa tub according to claim 26, wherein said outer bearing member is manufactured of a plastic material.

28. The spa tub according to claim 24, wherein said bearing assembly comprises an inner bearing member.

29. The spa tub according to claim 28, wherein said inner bearing member is manufactured of a rubber material.

30. The spa tub according to claim 9, further comprising a liner being positioned between said base of said jet assembly housing and said first surface of said mounting housing member.

31. The spa tub according to claim 9, further comprising at least one inlet aperture forming an outer diameter and wherein said outer diameter of said at least one inlet aperture is smaller than or equal to an outer diameter of an impeller.

32. The spa tub according to claim 9, wherein said at least one outlet aperture comprises a nozzle, and wherein said nozzle and an axis of said magnetic coupling fluid pump form an angle of less than 90 degree.

33. The spa tub according to claim 9, wherein said mounting housing member further comprises a flat section.

34. The spa tub according to claim 33, where said flat section is located at center of said mounting housing member.

* * * * *